US010286656B2

(12) United States Patent
Miyagishi

(10) Patent No.: US 10,286,656 B2
(45) Date of Patent: May 14, 2019

(54) LIQUID EJECTING APPARATUS, CONTROL DEVICE, RECORDING SYSTEM, CONTROL PROGRAM OF LIQUID EJECTING APPARATUS, RECORDING MEDIUM, AND IMAGE FORMING METHOD

(71) Applicant: SEIKO EPSON CORPORATION, Tokyo (JP)

(72) Inventor: Akira Miyagishi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/865,846

(22) Filed: Jan. 9, 2018

(65) Prior Publication Data

US 2018/0201012 A1 Jul. 19, 2018

(30) Foreign Application Priority Data

Jan. 18, 2017 (JP) ..... 2017-007058

(51) Int. Cl.
*B41J 2/045* (2006.01)
*B41J 2/155* (2006.01)

(52) U.S. Cl.
CPC ..... *B41J 2/04573* (2013.01); *B41J 2/04508* (2013.01); *B41J 2/04581* (2013.01); *B41J 2/04588* (2013.01); *B41J 2/04593* (2013.01); *B41J 2/155* (2013.01)

(58) Field of Classification Search
CPC ..... B41J 2/04573; B41J 2/04508; B41J 2/04581; B41J 2/04588; B41J 2/04593; B41J 2/155
USPC ..... 347/13
See application file for complete search history.

(56) References Cited

U.S. PATENT DOCUMENTS

2006/0274097 A1* 12/2006 Fujimoto ..... B41J 2/04508 347/15
2008/0143770 A1* 6/2008 Koase ..... B41J 2/04573 347/14

FOREIGN PATENT DOCUMENTS

JP 2007-144787 6/2007

* cited by examiner

*Primary Examiner* — Huan H Tran
*Assistant Examiner* — Alexander D Shenderov
(74) *Attorney, Agent, or Firm* — Workman Nydegger

(57) ABSTRACT

A liquid ejecting apparatus includes a nozzle row in which nozzles which discharge a liquid are provided to line up, drive elements for discharging the liquid from the nozzles, and a control unit which drives the drive elements, in which the control unit selects the nozzles which are necessary from the nozzle row based on recording data and causes the liquid to be discharged from the nozzles which are selected at a predetermined timing, and in which a nozzle group is configured by consecutive nozzles which are adjacent to each other among the nozzles which are selected at each timing and a discharge timing of the liquid to be discharged from the nozzles of end portions of the nozzle group is caused to deviate with respect to the discharge timing of the liquid to be discharged from the nozzles other than those of the end portions.

15 Claims, 13 Drawing Sheets

LIQUID EJECTING APPARATUS, CONTROL DEVICE, RECORDING SYSTEM, CONTROL PROGRAM OF LIQUID EJECTING APPARATUS, RECORDING MEDIUM, AND IMAGE FORMING METHOD

The entire disclosure of Japanese Patent Application No. 2017-007058, filed Jan. 18, 2017 is expressly incorporated by reference herein.

BACKGROUND

1. Technical Field

The present invention relates to a liquid ejecting apparatus which ejects a liquid from nozzles, a control device which controls the liquid ejecting apparatus, a recording system which includes the control device and the liquid ejecting apparatus, a control program which controls the liquid ejecting apparatus, a recording medium which stores the control program, and an image forming method of the liquid ejecting apparatus.

2. Related Art

An ink jet recording apparatus which causes ink droplets to be ejected as the liquid to perform printing on a medium such as paper or a recording sheet is known as an example of the liquid ejecting apparatus.

An ink jet recording head which is installed on the ink jet recording apparatus includes flow paths which communicate with nozzles, and drive elements such as piezoelectric actuators which generate pressure changes in an ink inside the flow paths, and the ink jet recording head generates pressure changes in the ink in the flow paths by driving the drive elements to discharge the ink droplets from the nozzles (for example, refer to JP-A-2007-144787).

However, when the ink droplets are discharged from consecutive adjacent nozzles, in the nozzles of the end portions among the consecutive nozzles which discharge the ink droplets, although the ink droplet is ejected from the adjacent nozzle on one side, the ink droplet is not ejected from the adjacent nozzle on the other side. Therefore, due to the influence of an air current of the ink droplet which is discharged from the adjacent nozzle on one side, the ink droplet which is discharged from the nozzle of an end portion flies bent toward the other side, that is, toward the outside. In contrast, in the nozzles other than the end portions among the consecutive nozzles which eject the ink droplets, since the ink droplets are discharged from both sides, the influence of air currents is received from both sides and flight bending does not occur easily. In this manner, in a case in which ink droplets are discharged at the same time from consecutive nozzles, landing position deviation occurs between the landing position of the ink droplet which is discharged from the nozzle of an end portion and the landing position of an ink droplet which is discharged from a nozzle other than an end portion, and there is a problem in that the print quality is reduced.

As in JP-A-2007-144787, although it is possible to adjust the flight direction of an ink droplet which is discharged from a nozzle of an end portion of a consecutive nozzle group by providing two pressure generating elements for one nozzle, two pressure generating elements are necessary for one nozzle and there is a problem in that the structure becomes complicated.

Furthermore, a method of suppressing landing position deviation by increasing the flight speed of the ink droplets which are discharged from the nozzles of the end portions among consecutive nozzles which discharge ink droplets in comparison to the flight speed of the ink droplets which are ejected from the nozzles other than those of the end portions is conceivable; however, due to increasing the flight speed of the ink droplets, the weight per single ink droplet also increases and there is a problem in that the printing density increases and the print quality is reduced.

This problem exists not only in an ink jet recording apparatus but also similarly in liquid ejecting apparatuses which eject liquids other than ink.

SUMMARY

An advantage of some aspects of the invention is to provide a liquid ejecting apparatus, a control device, a recording system, a control program of the liquid ejecting apparatus, a recording medium, and an image forming method which are capable of suppressing landing position deviation to improve print quality.

According to an aspect of the invention, there is provided a liquid ejecting apparatus including a nozzle row in which nozzles which discharge a liquid are provided to line up, drive elements for discharging the liquid from the nozzles, and a control unit which drives the drive elements to cause the liquid to be discharged from the nozzles, in which the control unit selects the nozzles which are necessary from the nozzle row based on recording data and causes the liquid to be discharged from the nozzles which are selected at a predetermined timing, and in which a nozzle group is configured by consecutive nozzles which are adjacent to each other among the nozzles which are selected at each timing and a discharge timing of the liquid to be discharged from the nozzles of end portions of the nozzle group is caused to deviate with respect to the discharge timing of the liquid to be discharged from the nozzles other than those of the end portions.

In this aspect, since it is possible to cause the flight position of the liquid which is discharged from the nozzles of the end portions which configure the nozzle group to deviate in the flight direction as compared to the flight position of the liquid which is discharged from the other nozzles, it is possible to suppress the influence of the air current of the liquid which is discharged from the adjacent nozzles on the liquid which is discharged from the nozzles of the end portions and it is possible to suppress flight bending. Since it is not necessary to change the flight speed of the liquid which is discharged from the nozzles of the end portions, it is possible to suppress the occurrence of irregularity in the printing density without changing the weight per droplet of the liquid which is discharged.

It is preferable that the control unit supply drive waveforms of the same shape to the drive elements corresponding to the nozzles which configure the nozzle group. Accordingly, it is possible to render the flight speed of the liquid and the weight per droplet of the liquid which is discharged from the nozzles which configure the nozzle group the same to suppress the occurrence of irregularity in the printing density.

It is preferable that, in a case in which two nozzles configure the nozzle group, the discharge timing of the liquid of one nozzle be caused to deviate with respect to the discharge timing of the liquid of the other nozzle. Accordingly, even if the nozzle group is configured by two nozzles, it is possible to reduce flight bending and landing position deviation of the liquid which is discharged from the nozzles.

It is preferable that an amount by which the control unit causes the discharge timing of the liquid to be ejected from the nozzles of the end portions of the nozzle group to deviate be an amount which does not overlap the drive waveforms which are supplied to the drive elements at a previous or a subsequent timing. Accordingly, it is possible to reduce the error in the landing positions of the liquid in which the discharge timing is caused to deviate.

It is preferable that an amount by which the control unit causes the discharge timing of the liquid to be ejected from the nozzles of the end portions of the nozzle group to deviate be an amount at which landing position deviation of less than or equal to half of one pixel on occurs on an ejection target medium. Accordingly, it is possible to reduce the error in the landing positions of the liquid in which the discharge timing is caused to deviate.

It is preferable that the control unit perform control with respect to the nozzle which is selected such that in a case in which the liquid is not ejected from the nozzles on both sides adjacent to the selected nozzle, a first discharge pulse is supplied to the drive element corresponding to the selected nozzle, in a case in which the liquid is ejected from the nozzles of both sides adjacent to the selected nozzle, the first discharge pulse is supplied to the drive element corresponding to the selected nozzle, in a case in which the liquid is ejected from one of the nozzles which are adjacent to the selected nozzle which is also a case in which the liquid is ejected from the nozzle which is adjacent two nozzles away from the selected nozzle on the one nozzle side, a second discharge pulse of a different discharge timing from that of the first discharge pulse is supplied to the drive element corresponding to the selected nozzle, and in a case in which the liquid is ejected from one nozzle among the nozzles which are adjacent to the selected nozzle which is also a case in which the liquid is not ejected from the nozzle which is adjacent two nozzles away from the selected nozzle on the one nozzle side, the second discharge pulse is supplied to the drive element corresponding to the nozzle which is either an odd number of nozzles or an even number of nozzles away from a predetermined position among the nozzles which configure the nozzle row and the first discharge pulse is supplied to the drive element corresponding to the other nozzle. Accordingly, it is possible to suppress the flight bending of the liquid which is discharged from the nozzles of the end portions corresponding to a case in which greater than or equal to three or a case in which two nozzles configure the nozzle group.

It is preferable that a flight speed of the liquid which is ejected from the nozzles which configure the consecutive nozzle group be the same. Accordingly, it is possible to render the weight per droplet of the liquid which is discharged from the nozzles which configure the nozzle group the same and it is possible to suppress irregularity in the printing density.

It is preferable that a weight of the liquid which is ejected from the nozzles which configure the consecutive nozzle group be the same. Accordingly, it is possible to render the weight per droplet of the liquid which is discharged from the nozzles which configure the nozzle group the same and it is possible to suppress irregularity in the printing density.

It is preferable that the control unit perform control such that a first drive signal and a second drive signal having different discharge timing of the liquid from each other to the drive elements, the first drive signal is supplied are supplied to the drive elements corresponding to the nozzles other than those of the end portions of the nozzle group, and the second drive signal is supplied to the drive elements corresponding to the nozzles of the end portions of the nozzle group. Accordingly, it is possible to easily supply drive signals of different discharge timings. Since the supply timing is merely changed between the first drive signal and the second drive signal in order to change the discharge timing, it is possible to set the supply timing to be arbitrarily short to suppress a reduction in the printing speed.

It is preferable that the control unit perform control such that a drive signal which includes discharge pulses which are repeated in a unit period and in which the discharge pulses include a first discharge pulse and a second discharge pulse is supplied to the drive elements, the first discharge pulse is supplied to the drive elements corresponding to the nozzles other than those of the end portions of the nozzle group, and the second discharge pulse is supplied to the drive elements corresponding to the nozzles of the end portions of the nozzle group. Accordingly, it is possible to easily supply drive signals of different discharge timings. Since one type of the drive signal is sufficient, it is possible to simplify the configuration of the control unit and it is possible to reduce the cost.

It is preferable that the control unit perform control such that a drive signal including a plurality of reference discharge pulses is generated, a first discharge pulse which is formed by selecting and compositing a plurality of the reference discharge pulses is supplied to the drive elements corresponding to the nozzles other than those of the end portions of the nozzle group, and a second discharge pulse which is formed by deviating a selection position of the reference discharge pulse before compositing is supplied to the drive elements corresponding to the nozzles of the end portions of the nozzle group. Accordingly, it is possible to easily supply drive signals of different discharge timings.

According to another aspect of the invention, there is provided a control device which is capable of being connected to a liquid ejecting apparatus that includes a nozzle row in which nozzles which discharge a liquid are provided to line up and drive elements for discharging the liquid from the nozzles, the control device including a control unit which drives the drive elements to cause the liquid to be discharged from the nozzles, in which the control unit selects the nozzles which are necessary from the nozzle row based on recording data and causes the liquid to be discharged from the nozzles which are selected at a predetermined timing, and in which a nozzle group is configured by consecutive nozzles which are adjacent to each other among the nozzles which are selected at each timing and a discharge timing of the liquid to be discharged from the nozzles of end portions of the nozzle group is caused to deviate with respect to the discharge timing of the liquid to be discharged from the nozzles other than those of the end portions.

In this aspect, since it is possible to cause the flight position of the liquid which is discharged from the nozzles of the end portions which configure the nozzle group to deviate in the flight direction as compared to the flight position of the liquid which is discharged from the other nozzles, it is possible to realize a control device which is capable of suppressing the influence of the air current of the liquid which is discharged from the adjacent nozzles on the liquid which is discharged from the nozzles of the end portions and suppresses flight bending. Since it is not necessary to change the flight speed of the liquid which is discharged from the nozzles of the end portions, it is possible to realize a control device which suppresses the occurrence of irregularity in the printing density without changing the weight per droplet of the liquid which is discharged.

According to still another aspect of the invention, there is provided a recording system including the control device according to the aspect described above, and a liquid ejecting apparatus which is capable of being connected to the control device and includes a nozzle row in which nozzles which perform ejecting are provided to line up and drive elements for ejecting a liquid from the nozzles.

In this aspect, since it is possible to cause the flight position of the liquid which is discharged from the nozzles of the end portions which configure the nozzle group to deviate in the flight direction as compared to the flight position of the liquid which is discharged from the other nozzles, it is possible to realize a recording system which is capable of suppressing the influence of the air current of the liquid which is discharged from the adjacent nozzles on the liquid which is discharged from the nozzles of the end portions and suppresses flight bending. Since it is not necessary to change the flight speed of the liquid which is discharged from the nozzles of the end portions, it is possible to realize a recording system which suppresses the occurrence of irregularity in the printing density without changing the weight per droplet of the liquid which is discharged.

According to still another aspect of the invention, there is provided a control program which realizes a function of controlling discharging of a liquid of a liquid ejecting apparatus which includes a nozzle row in which nozzles which discharge a liquid are provided to line up and drive elements for discharging the liquid from the nozzles, the control program of the liquid ejecting apparatus including selecting the nozzles which are necessary from the nozzle row based on recording data and causing the liquid to be discharged from the nozzles which are selected at a predetermined timing, and configuring a nozzle group by consecutive nozzles which are adjacent to each other among the nozzles which are selected at each timing and causing a discharge timing of the liquid to be discharged from the nozzles of end portions of the nozzle group to deviate with respect to the discharge timing of the liquid to be discharged from the nozzles other than those of the end portions.

In this aspect, since it is possible to cause the flight position of the liquid which is discharged from the nozzles of the end portions which configure the nozzle group to deviate in the flight direction as compared to the flight position of the liquid which is discharged from the other nozzles, it is possible to realize a control program which is capable of suppressing the influence of the air current of the liquid which is discharged from the adjacent nozzles on the liquid which is discharged from the nozzles of the end portions and suppresses flight bending. Since it is not necessary to change the flight speed of the liquid which is discharged from the nozzles of the end portions, it is possible to realize a control program of a liquid ejecting apparatus which suppresses the occurrence of irregularity in the printing density without changing the weight per droplet of the liquid which is discharged.

According to still another aspect of the invention, there is provided a computer readable recording medium storing the control program of the liquid ejecting apparatus according to the aspect described above.

In this aspect, it is possible to realize a recording medium which stores the control program.

According to still another aspect of the invention, there is provided an image forming method of a liquid ejecting apparatus which includes a nozzle row in which nozzles which discharge a liquid are provided to line up and drive elements for discharging the liquid from the nozzles, the method including selecting the nozzles which are necessary from the nozzle row based on recording data and causing the liquid to be discharged from the nozzles which are selected at a predetermined timing, and configuring a nozzle group by consecutive nozzles which are adjacent to each other among the nozzles which are selected at each timing and causing a discharge timing of the liquid to be discharged from the nozzles of end portions of the nozzle group to deviate with respect to the discharge timing of the liquid to be discharged from the nozzles other than those of the end portions.

In this aspect, since it is possible to cause the flight position of the liquid which is discharged from the nozzles of the end portions which configure the nozzle group to deviate in the flight direction as compared to the flight position of the liquid which is discharged from the other nozzles, it is possible to suppress the influence of the air current of the liquid which is discharged from the adjacent nozzles on the liquid which is discharged from the nozzles of the end portions and it is possible to suppress flight bending. Since it is not necessary to change the flight speed of the liquid which is discharged from the nozzles of the end portions, it is possible to suppress the occurrence of irregularity in the printing density without changing the weight per droplet of the liquid which is discharged.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a detailed description will be given of the embodiments of the invention.

First Embodiment

Figure 1:
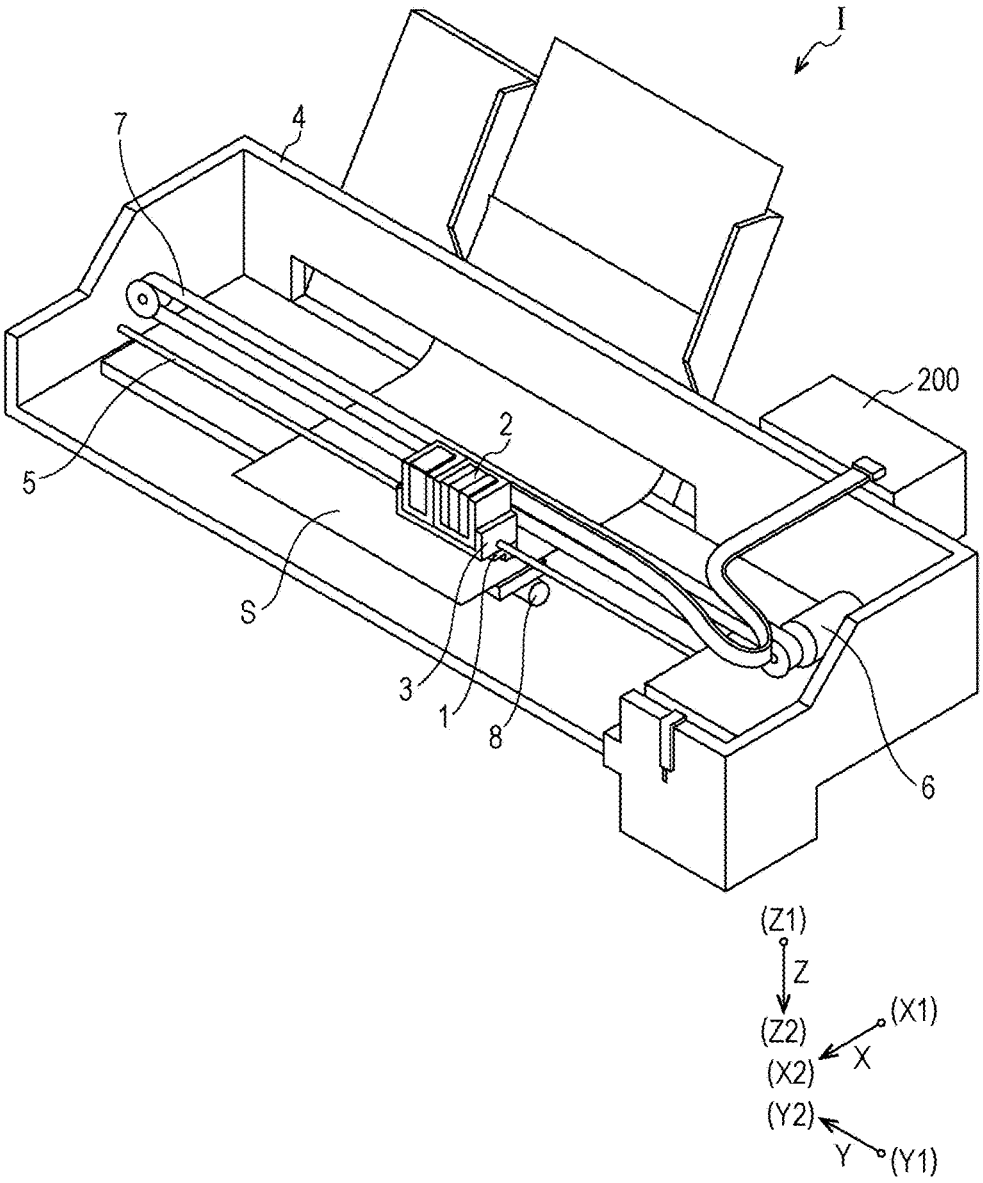
FIG. 1 is a diagram illustrating the schematic configuration of a recording apparatus.

FIG. 1 is a diagram illustrating the schematic configuration of an ink jet recording apparatus which is an example of the liquid ejecting apparatus according to the first embodiment of the invention.

As illustrated in FIG. 1, an ink jet recording apparatus I which is an example of the liquid ejecting apparatus of the present embodiment includes an ink jet recording head 1 (hereinafter also referred to as the recording head 1) which ejects an ink which serves as a liquid as ink droplets. The recording head 1 is mounted on a carriage 3 and the carriage 3 is provided on a carriage shaft 5 which is attached to an apparatus main body 4 such that the carriage 3 is capable of moving in an axial direction of the carriage shaft 5. An ink cartridge 2 which configures a liquid supply unit is provided in the carriage 3 to be attachable and detachable.

The carriage 3 to which the recording head 1 is mounted moves reciprocally along the carriage shaft 5 due to the driving force of a drive motor 6 being transmitted to the carriage 3 via a plurality of gears (not illustrated) and a timing belt 7. Meanwhile, the apparatus main body 4 is provided with a transport roller 8 as a transport unit and a recording sheet S, which is an ejection target medium such as paper on which the ink lands, is transported by the transport roller 8. The transport unit which transports the recording sheet S is not limited to being a transport roller and may be a belt, a drum, or the like. In the present embodiment, a transport direction of the recording sheet S is referred to as a first direction X, the upstream side of the recording sheet S in the transport direction is referred to as X1, and the downstream side is referred to as X2. A movement direction of the carriage 3 along the carriage shaft 5 is referred to as a second direction Y, one end portion side of the carriage shaft 5 in the movement direction is referred to as Y1, and the other end portion side is referred to as Y2. Incidentally, the Y1 side which is the one end portion side of the carriage shaft 5 is a home position of the carriage 3, and while not particularly illustrated, a cleaning unit or the like which cleans a liquid ejecting surface and the like of the recording head 1 from which the ink droplets are ejected. A direction intersecting both the first direction X and the second direction Y is referred to as a third direction Z in the present embodiment, the recording head 1 side with respect to the recording sheet S is referred to as Z1, and the recording sheet S side with respect to the recording head 1 is referred to as Z2. In the present embodiment, the relationship between the directions (X, Y, and Z) is perpendicular; however, the dispositional relationship of the configuration elements is not necessarily limited to being perpendicular.

In the ink jet recording apparatus I, printing is performed across substantially the entire surface of the recording sheet S by causing ink droplets to be ejected from the recording head 1 while transporting the recording sheet S in the first direction X with respect to the recording head 1 and causing the carriage 3 to move reciprocally in the second direction Y with respect to the recording sheet S.

Figure 2:
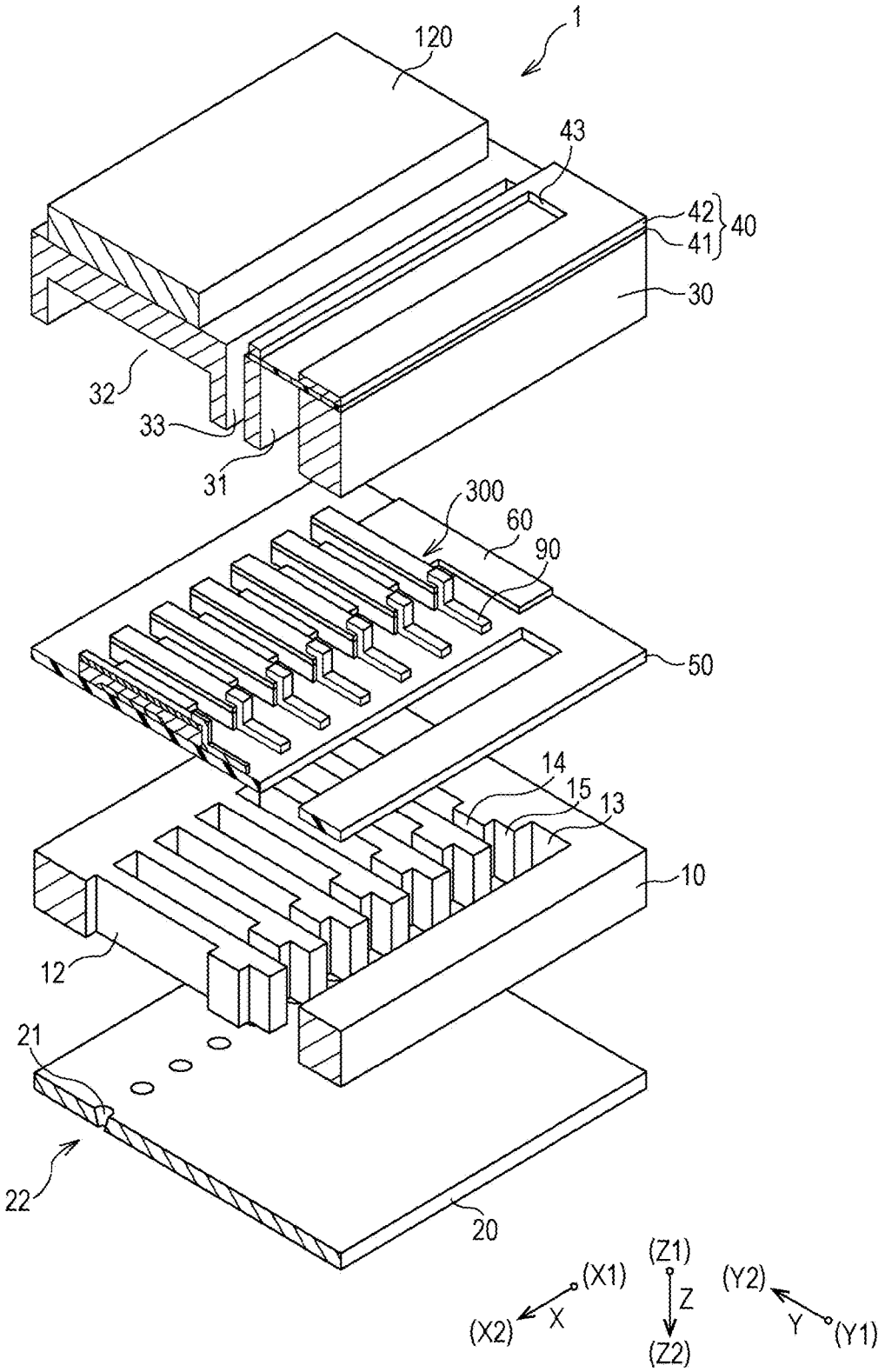
FIG. 2 is an exploded perspective diagram of a recording head.
Figure 3:
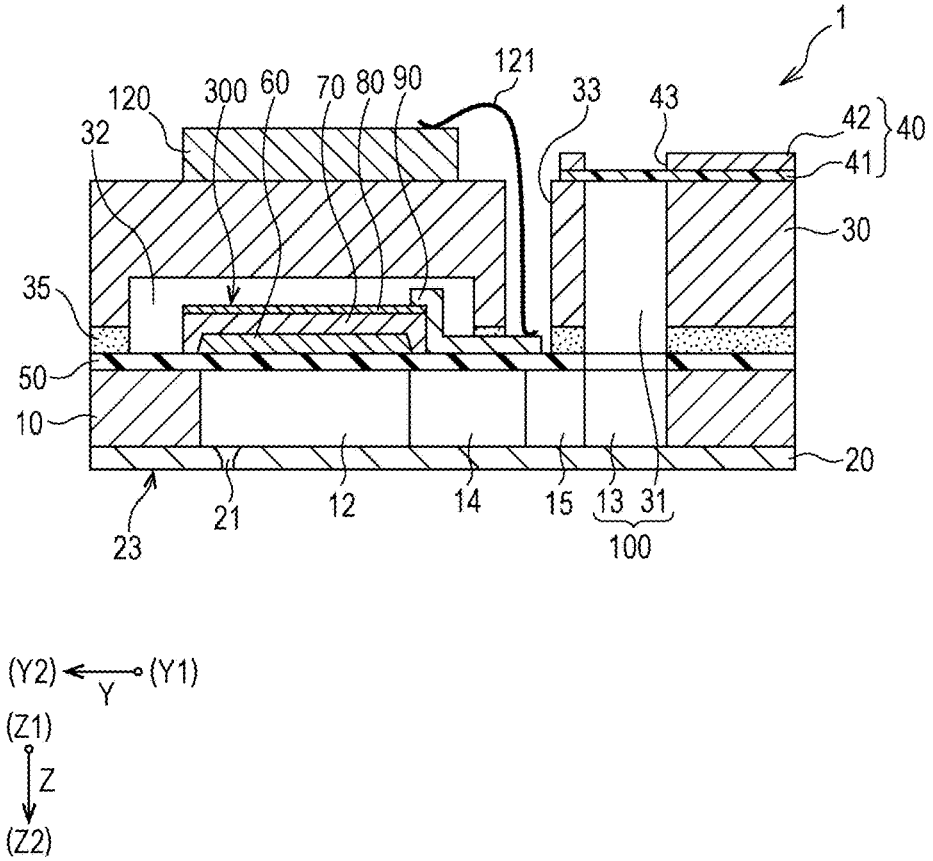
FIG. 3 is a sectional diagram of the recording head.

Here, a description will be given of an example of the recording head 1 which is mounted on the ink jet recording apparatus with reference to FIGS. 2 and 3. FIG. 2 is an exploded perspective diagram of an ink jet recording head, which is an example of the liquid ejecting head according to the first embodiment of the invention, and FIG. 3 is a sectional view of the recording head along the second direction Y. In the present embodiment, a description will be given of the directions of the recording head based on the directions when the ink jet recording apparatus I is mounted, that is, based on the first direction X, the second direction Y, and the third direction Z. Naturally, the disposition of the recording head 1 inside the ink jet recording apparatus I is not limited to the disposition which is illustrated hereinafter.

As illustrated in FIGS. 2 and 3, a flow path forming substrate 10 which configures the recording head 1 of the present embodiment is composed of a silicon single crystal substrate and has a diaphragm 50 formed on one surface. The diaphragm 50 may be a single layer or laminated, selected from a silicon dioxide layer and a zirconium oxide layer.

A plurality of pressure generating chambers 12 is provided to line up along the first direction X in the flow path forming substrate 10. A communicating portion 13 is formed in a region outside the first direction X of the pressure generating chambers 12 in the flow path forming substrate 10 and the communicating portion 13 and each of the pressure generating chambers 12 communicate with each other via an ink supply path 14 and a communicating path 15 which are provided for each of the pressure generating chambers 12. The communicating portion 13 communicates with a manifold portion 31 of a protective substrate (described later) to configure a portion of a manifold 100 that serves as a common ink chamber for the pressure generating chambers 12. The ink supply path 14 is formed to be narrower in width than the pressure generating chamber 12 and holds a constant flow path resistance to ink flowing into the pressure generating chamber 12 from the communicating portion 13.

A nozzle plate 20 which is provided with a punctured nozzle 21 that communicates with the vicinity of the end portion on the opposite side from the ink supply path 14 of each of the pressure generating chambers 12 is fixed to the surface on the Z2 side of the flow path forming substrate 10 in the third direction Z using an adhesive, a thermally weldable film, or the like. In the present embodiment, a plurality of the nozzles 21 is provided to line up in the first direction X such that the second direction Y is the same position and a nozzle row 22 is configured by the nozzles 21 which are provided to line up in the first direction X. The disposition of the nozzles 21 is not particularly limited thereto, and for example, in the nozzles 21 which are provided to line up in the first direction X, a so-called zigzag disposition in which every other nozzle 21 is disposed at a position which deviates in the second direction Y. Naturally, a plurality of the nozzle rows 22 may be formed in the second direction Y, a direction which intersects both the first direction X and the second direction Y, or the like.

The nozzle plate 20 is composed of, for example, a glass ceramic, a silicon single crystal substrate, stainless steel, or the like. The Z2 side surface of the nozzle plate 20 in which the nozzles 21 are opened forms a liquid ejecting surface 23 of the present embodiment.

Meanwhile, the diaphragm 50 is formed on the Z1 side surface of the flow path forming substrate 10 as described above, and a first electrode 60, a piezoelectric layer 70, and a second electrode 80 are laminated onto the diaphragm 50 using film forming and a lithography method to configure a piezoelectric actuator 300. In the present embodiment, the piezoelectric actuator 300 forms a drive element which generates a pressure change in the ink inside the pressure generating chamber 12. Here, the piezoelectric actuator 300 is also referred to as a piezoelectric element and refers to a portion including the first electrode 60, the piezoelectric layer 70, and the second electrode 80. Generally, a configuration is adopted in which one of the electrodes in the piezoelectric actuator 300 is a common electrode and the other electrode and the piezoelectric layer 70 are patterned for each of the pressure generating chambers 12. In the present embodiment, although the first electrode 60 is used as the common electrode of the piezoelectric actuator 300 and the second electrode 80 is used as the individual electrode of the piezoelectric actuator 300, this may be reversed according to the circumstances of a drive circuit or wiring. In the example which is described above, the diaphragm 50 and the first electrode 60 act as a diaphragm; however, naturally, the configuration is not limited thereto, and, for example, a configuration may be adopted in which only the first electrode 60 acts as the diaphragm without providing the diaphragm 50. The piezoelectric actuator 300 itself may also function effectively as the diaphragm.

A lead electrode 90 is connected to the second electrode 80 of each of the piezoelectric actuators 300 and a voltage is applied selectively to each of the piezoelectric actuators 300 via the lead electrode 90.

A protective substrate 30 which includes the manifold portion 31 which configures at least a portion of the manifold 100 is bonded to the surface of the flow path forming substrate 10 on the piezoelectric actuator 300 side via an adhesive 35. In the present embodiment, the manifold portion 31 penetrates the protective substrate 30 in the third direction Z, is formed along the width direction of the pressure generating chambers 12, and communicates with the communicating portion 13 of the flow path forming substrate 10 as described above to configure the manifold 100 that serves as the common ink chamber of the pressure generating chambers 12.

A piezoelectric actuator holding portion 32 having a space that does not hinder the motion of the piezoelectric actuator 300 is provided in a region of the protective substrate 30 which faces the piezoelectric actuator 300. The piezoelectric actuator holding portion 32 may have a space that does not hinder the motion of the piezoelectric actuator 300 and the space may or may not be sealed.

It is preferable to use materials having substantially the same coefficient of thermal expansion as the flow path forming substrate 10, for example, glass, ceramics, and other materials, as the protective substrate 30, and in the present embodiment, the protective substrate is formed using a silicon single crystal substrate of the same material as the flow path forming substrate 10.

A through hole 33 that penetrates the protective substrate 30 in the third direction Z is provided in the protective substrate 30. The through hole 33 is provided so that the vicinity of the end portion of the lead electrode 90 drawn from each of the piezoelectric actuators 300 is exposed to the inside of the through hole 33.

A drive circuit 120 for driving the piezoelectric actuators 300 is provided on the Z1 side surface of the protective substrate 30. It is possible to use, for example, a circuit board, a semiconductor integrated circuit (IC), or the like as the drive circuit 120. The drive circuit 120 and the lead electrodes 90 are electrically connected via a connection wiring 121 composed of conductive wire such as bonding wire.

A compliance substrate 40 composed of a sealing film 41 and a fixing plate 42 is bonded to the surface of the Z1 side of the protective substrate 30. Here, the sealing film 41 is composed of a flexible material having low rigidity and one surface of the manifold portion 31 is sealed by the sealing film 41. The fixing plate 42 is formed of a relatively hard material. Since the region of the fixing plate 42 facing the manifold 100 forms an opening portion 43 that is fully removed in the thickness direction, the one surface of the manifold 100 is sealed only by the flexible sealing film 41.

In the recording head 1 of the present embodiment, an ink is taken in from the ink cartridge 2 illustrated in FIG. 1, the inside from the manifold 100 to the nozzles 21 is filled with the ink, a voltage is applied between each pair of the first electrode 60 and the second electrode 80 which corresponds to the pressure generating chamber 12 according to drive signals from the drive circuit 120, and the diaphragm 50 and the piezoelectric actuator 300 are caused to deform in a flexural manner, thereby increasing the pressure in each of the pressure generating chambers 12 and discharging ink droplets from the nozzles 21.

Figure 4:
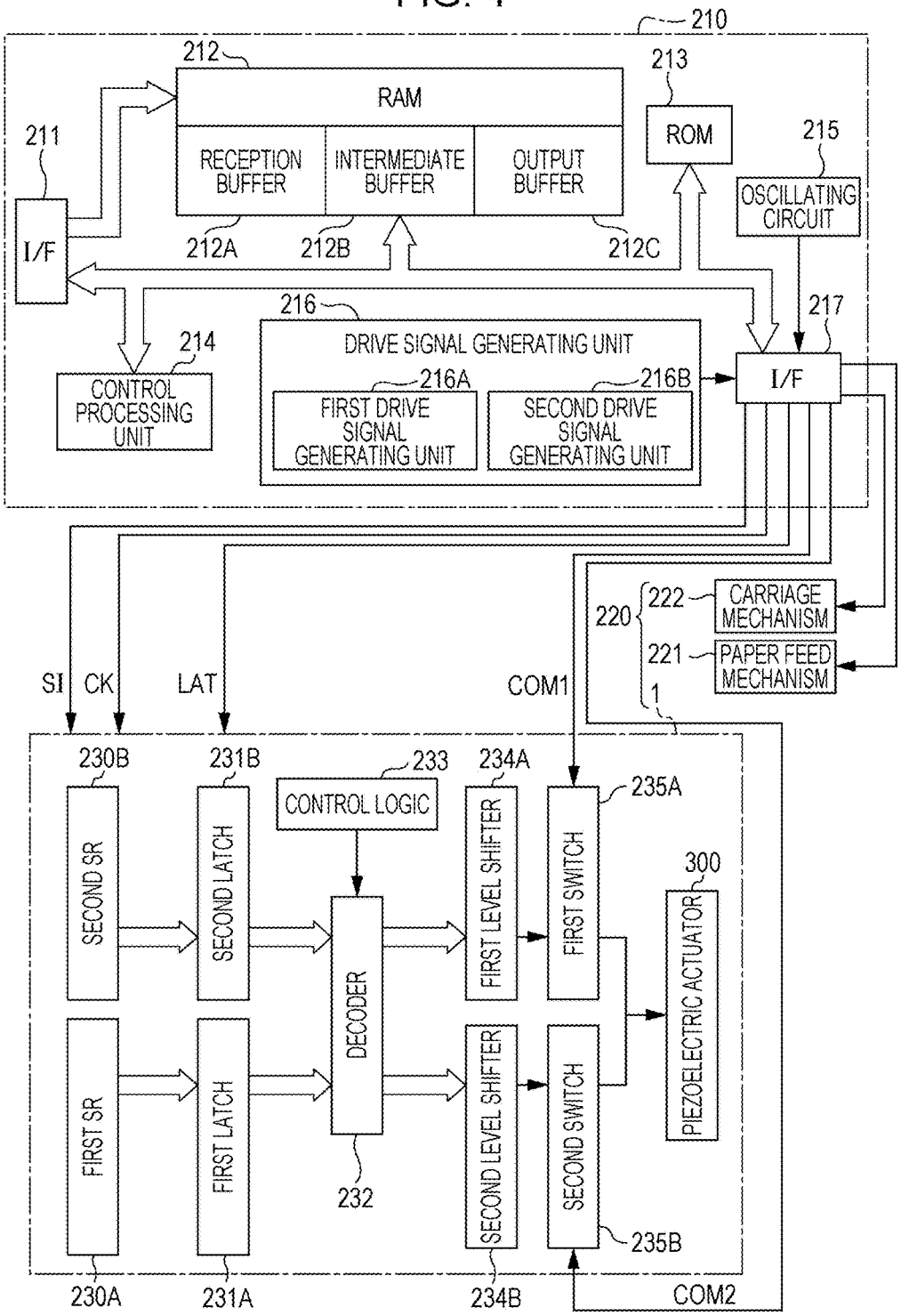
FIG. 4 is a block diagram illustrating an electrical configuration of the recording apparatus.

As illustrated in FIGS. 1 and 4, the ink jet recording apparatus I includes a control device 200. Here, a description will be given of the electrical configuration of the present embodiment with reference to FIG. 4. FIG. 4 is a block diagram illustrating the electrical configuration of the ink jet recording apparatus according to the first embodiment of the invention.

As illustrated in FIG. 4, the ink jet recording apparatus I is provided with a printer controller 210, which is the control unit of the present embodiment, and a print engine 220.

The printer controller 210 is an element which controls the entirety of the ink jet recording apparatus I, and in the present embodiment, is provided inside the control device 200 which is provided in the ink jet recording apparatus I.

The printer controller 210 is provided with an external interface 211 (hereinafter referred to as the external I/F 211), a RAM 212 which temporarily stores various data, a ROM 213 which stores control programs and the like, a control processing unit 214 which is configured to include a CPU and the like, an oscillating circuit 215 which generates a clock signal (CK), a drive signal generating unit 216 which generates a drive signal for supplying to the recording head 1, and an internal interface 217 (hereinafter referred to as the internal I/F 217) which transmits dot pattern data (bitmap data) which is expanded based on the drive signal and the print data to the print engine 220.

The external I/F 211 receives the print data which is configured by character codes, graphic functions, image data, and the like, for example, from a host computer (not illustrated) or the like. Busy signals (BUSY) and acknowledgment signals (ACK) are outputted to an external device such as the host computer through the external I/F 211. The RAM 212 functions as a reception buffer 212A, an intermediate buffer 212B, an output buffer 212C, and a work memory (not illustrated). The reception buffer 212A temporarily stores the print data which is received by the external I/F 211, the intermediate buffer 212B stores intermediate code data which is converted by the control processing unit 214, and the output buffer 212C stores dot pattern data. The dot pattern data is configured by recording data (SI) which is obtained by decoding (translating) gradation data.

The drive signal generating unit 216 includes a first drive signal generating unit 216A and a second drive signal generating unit 216B. The first drive signal generating unit 216A is a first drive signal generator which is capable of generating a first drive signal COM1 and the second drive signal generating unit 216B is a second drive signal generator which is capable of generating a second drive signal COM2.

Here, the first drive signal COM1 which is generated by the first drive signal generating unit 216A is a signal which includes a first discharge pulse DP1 that drives the piezoelectric actuator 300 to discharge an ink droplet from the nozzle 21 in a single recording period T, and the first drive signal COM1 is repeatedly generated every recording period T.

Although described later in detail, the second drive signal COM2 which is generated by the second drive signal generating unit 216B is a signal which includes a second discharge pulse DP2 that drives the piezoelectric actuator 300 to discharge an ink droplet from the nozzle in a single recording period T, and the second drive signal COM2 is repeatedly generated every recording period T. The second discharge pulse DP2 is generated in the same recording period T as the first discharge pulse DP1 at a different timing. The recording period T is the repetition unit of the drive signal COM, is a type of discharge period in the invention, and corresponds to one pixel worth of the image to be printed on the recording sheet S. A detailed description will be given later of the first drive signal COM1 and the second drive signal COM2.

In addition to control programs (control routines) for causing various data processes to be performed, the ROM 213 is caused to store font data, graphic functions, and the like in advance. The control processing unit 214 reads out the print data in the reception buffer 212A and causes the intermediate code data which is obtained by converting the print data to be stored in the intermediate buffer 212B. The intermediate code data which is read out from the intermediate buffer 212B is analyzed and the intermediate code data is expanded into the dot pattern data with reference to the font data, graphic functions, and the like which are stored in the ROM 213. The control processing unit 214 performs the necessary auxiliary processes and subsequently stores the expanded dot pattern data in the output buffer 212C.

If the dot pattern data corresponding to one line of the recording head 1 is obtained, the one line worth of dot pattern data is output to the recording head 1 through the internal I/F 217. When the one line worth of dot pattern data is output from the output buffer 212C, the expanded intermediate code data is erased from the intermediate buffer 212B and the expanding process is performed for the next item of intermediate code data.

Although a detailed description will be given later, when generating the recording data such as the dot pattern data based on the print data and the like which is received from an external device via the external I/F 211, in one line worth of dot pattern data, a nozzle group 24 is configured by consecutive adjacent nozzles 21 from which ink droplets are to be discharged, and the control processing unit 214 of the printer controller 210 realizes a function of deviating the discharge timing of the ink droplets to be discharged from the nozzles 21 of the end portions among the nozzles 21 which configure the nozzle group 24 with respect to the discharge timing of the ink droplets to be discharged from the nozzles 21 other than the end portions. The control program is loaded from a recording medium such as a floppy disc, a CD ROM, a DVD ROM, a USB memory, or the like which is directly connected via the external I/F 211 or is connected via the host computer. Naturally, the control program may be provided as a printer driver in the host computer. In a case in which the control program is provided in the host computer, the control unit described in an aspect of the invention serves as the host computer which includes the control program.

The print engine 220 is configured to include the recording head 1, a paper feed mechanism 221, and a carriage mechanism 222. The paper feed mechanism 221 is configured by the transport roller 8 and a motor or the like (not illustrated) which drives the transport roller 8 and sequentially feeds out the recording sheet S in cooperation with the recording operation of the recording head 1. In other words, the paper feed mechanism 221 moves the recording sheet S relative to the first direction X. The carriage mechanism 222 includes the carriage 3, the drive motor 6 which causes the carriage 3 to move along the carriage shaft 5 in the second direction Y, and the timing belt 7.

The recording head 1 includes the nozzle row 22 in which the plurality of nozzles 21 is provided to line up along the first direction X which is a sub-scanning direction and discharged an ink droplet which is a liquid droplet from each of the nozzles 21 at defined timings according to dot pattern data and the like.

Here, a description will be given of the electrical configuration of the recording head 1 of the present embodiment. As illustrated in FIG. 4, the recording head 1 includes a shift register circuit which is composed of a first shift register 230A and a second shift register 230B, a latch circuit which is composed of a first latch circuit 231A and a second latch circuit 231B, a decoder 232, a control logic 233, a level shifter circuit composed of a first level shifter 234A and a second level shifter 234B, a switch circuit composed of a first switch 235A and a second switch 235B, and the piezoelectric actuator 300. The shift registers 230A and 230B, the latch circuits 231A and 231B, the level shifters 234A and 234B, the switches 235A and 235B, and the piezoelectric actuator 300 are provided corresponding to each of the nozzles 21.

The recording head 1 discharges the ink droplets based on the recording data (SI) from the printer controller 210. In the present embodiment, since the recording data is transmitted to the recording head 1 in the order of a high-order bit group of the recording data and a low-order bit group of the recording data, first, the high-order bit group of the recording data is set in the second shift register 230B. When the high-order bit groups of the recording data are set in the second shift registers 230B for all of the nozzles 21, the high-order bit groups are shifted to the first shift registers 230A. At the same time, the low-order bit group of the recording data is set in the second shift register 230B.

The first latch circuit 231A is electrically connected to the later stage of the first shift register 230A and the second latch circuit 231B is electrically connected to the later stage of the second shift register 230B. When the latch signal (LAT) from the printer controller 210 is input to the latch circuits 231A and 231B, the first latch circuit 231A latches the high-order bit group of the recording data and the second latch circuit 231B latches the low-order bit group of the recording data. The recording data (the high-order bit group and the low-order bit group) which are latched by the latch circuits 231A and 231B are output to the decoder 232. The decoder 232 generates pulse selection data for selecting the first discharge pulse DP1 and the second discharge pulse DP2 which configure the first drive signal COM1 and the second drive signal COM2 based on the high-order bit group and the low-order bit group of the recording data.

The pulse selection data is generated for each of the first drive signals COM1 and the second drive signals COM2. In other words, the first pulse selection data corresponding to the first drive signal COM1 is configured by one bit of data. The second pulse selection data corresponding to the second drive signal COM2 is configured by one bit of data.

A timing signal from the control logic 233 is also input to the decoder 232. The control logic 233 generates the timing signal in synchronization with the input of the latch signal and a channel signal. The timing signal is also generated for each of the first drive signals COM1 and the second drive signals COM2. The items of pulse selection data which are generated by the decoder 232 are input to the level shifters 234A and 234B sequentially from the high-order bit side at a timing which is defined by the timing signal. The level shifters 234A and 234B function as voltage amplifiers, and in a case in which the pulse selection data is "1", the level shifters 234A and 234B output voltage values which the corresponding switches 235A and 235B are capable of driving, for example, electrical signals which are raised by several tens of volts. In other words, in a case in which the first pulse selection data is "1", the electrical signal is output to the first switch 235A, and in a case in which the second pulse selection data is "1", the electrical signal is output to the second switch 235B and a connection state is assumed.

The first drive signal COM1 from the first drive signal generating unit 216A is supplied to the input side of the first switch 235A and the second drive signal COM2 from the second drive signal generating unit 216B is supplied to the input side of the second switch 235B. The piezoelectric actuator 300 is electrically connected to the output side of each of the switches 235A and 235B. The first switch 235A and the second switch 235B are provided for each type of drive signal which is generated, are interposed between the drive signal generating unit 216 and the piezoelectric actuator 300, and selectively supply the first drive signal COM1 and the second drive signal COM2 to the piezoelectric actuator 300. When the first switch 235A and the second switch 235B are both in a disconnected state, the first drive signal COM1 and the second drive signal COM2 are not supplied to the piezoelectric actuator 300.

The pulse selection data controls the operations of the switches 235A and 235B. In other words, during a period in which the pulse selection data which is input to the first switch 235A is "1", the first switch 235A enters a connected conducting state and the first drive signal COM1 is supplied to the piezoelectric actuator 300. Similarly, during a period in which the pulse selection data which is input to the second switch 235B is "1", the second switch 235B enters the connected conducting state and the second drive signal COM2 is supplied to the piezoelectric actuator 300. The drive signal which is applied to the piezoelectric actuator 300 changes according to the first drive signal COM1 and the second drive signal COM2 which are supplied. Meanwhile, during a period in which the items of pulse selection data which are input to the switches 235A and 235B are both "0", the switches 235A and 235B enter the disconnected state and the first drive signal COM1 and the second drive signal COM2 are not supplied to the piezoelectric actuator 300. In other words, the pulse of a period in which the pulse selection data is set to "1" is supplied to the piezoelectric actuator 300. In a period in which the items of pulse selection data are both "0", since each of the piezoelectric actuators 300 holds the potential from directly before, the displacement state of directly before is maintained.

In this manner, in the present embodiment, the decoder 232, the control logic 233, the level shifters 234A, 234B, and the switches 235A and 235B function as a drive element controller and control the behavior of the piezoelectric actuator 300 by controlling the supply of the first drive signal COM 1 and the second drive signal COM2 according to the recording data (the gradation data).

Figure 5:
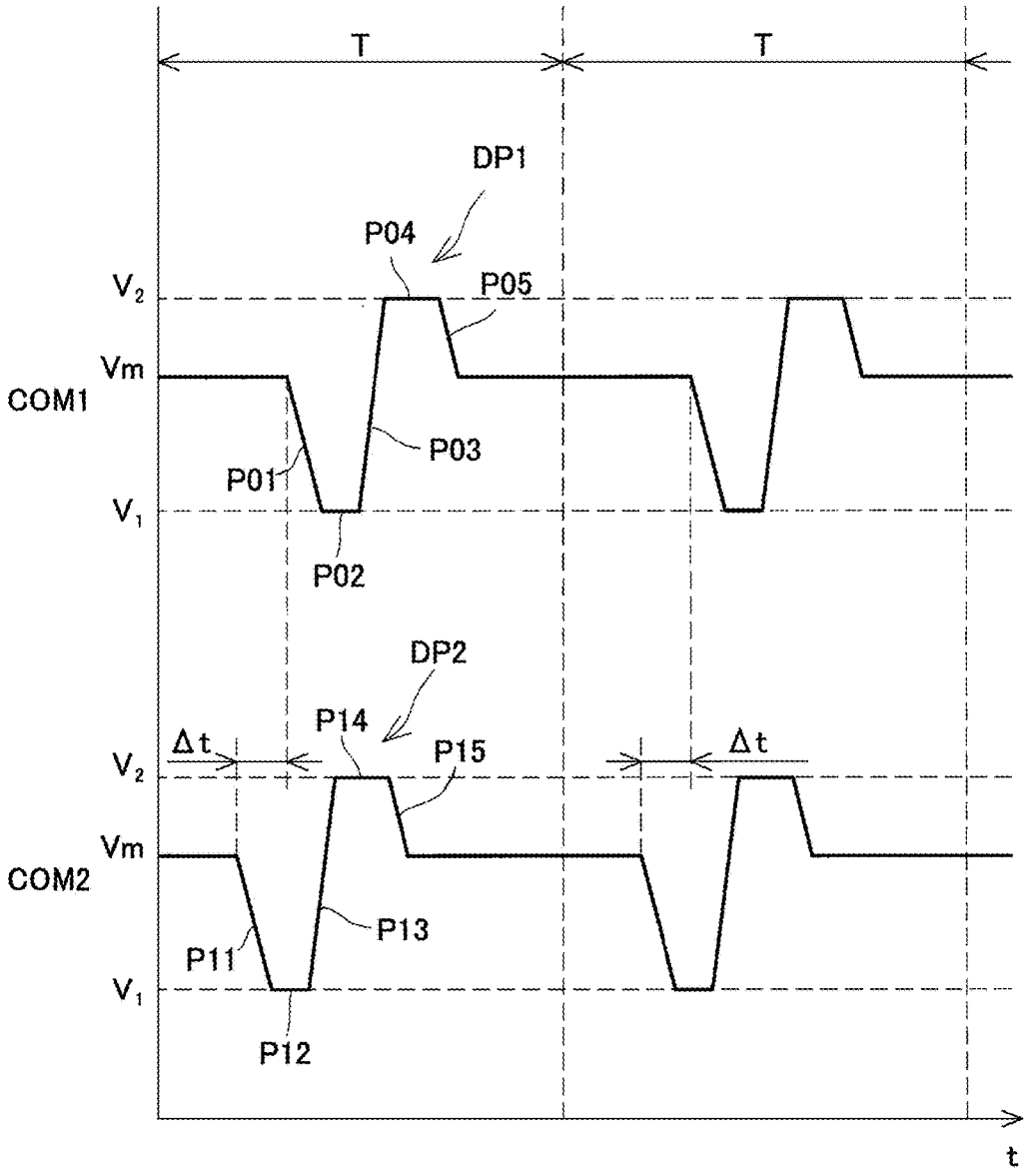
FIG. 5 shows drive waveforms illustrating drive signals.

Next, a description will be given of the first drive signal COM1 and the second drive signal COM2 which are generated by the drive signal generating unit 216 and the supply control of the first drive signal COM1 and the second drive signal COM2 to the piezoelectric actuator 300. FIG. 5 shows drive waveforms illustrating drive signals.

The drive waveforms illustrating the drive signals illustrated in FIG. 5 are composed of the first drive signal COM1 and the second drive signal COM2.

The first drive signal COM1 is repeatedly generated from the first drive signal generating unit 216A of the drive signal generating unit 216 for every unit period T (this is the discharge period T and is also referred to as the recording period T) which is defined by the clock signal which is emitted from the oscillating circuit 215. The unit period T corresponds to one pixel of the image or the like to be printed onto the recording sheet S. In the present embodiment, the first discharge pulse DP1 is generated in the unit period T.

In the same manner, the second drive signal COM2 is repeatedly generated from the second drive signal generating unit 216B of the drive signal generating unit 216 for every unit period T, which is the same unit period T as the first drive signal COM1. In the present embodiment, the second discharge pulse DP2 is generated in the unit period T. When one line worth (one raster worth) of the dot pattern is formed in the recording region of the recording sheet S during the printing, one of the first discharge pulse DP1 and the second discharge pulse DP2 is selectively supplied to the piezoelectric actuator 300 corresponding to each of the nozzles 21. In the present embodiment, the first drive signal COM1 and the second drive signal COM2 are supplied to the second electrode 80 which is the individual electrode using the first electrode 60 which is the common electrode of the piezoelectric actuator 300 as a reference potential (vbs). In other words, the voltage which is applied to the second electrode 80 by the drive signal is represented as the potential which is based on the reference potential (vbs).

Specifically, the first discharge pulse DP1 of the first drive signal COM1 includes a first expanding element P01, a first expansion maintenance element P02, a first contracting element P03, a first contraction maintenance element P04, and a first expanding recovery element P05. The first expanding element P01 is applied from a state in which an intermediate potential Vm is applied to a first potential $V_1$ to cause the volume of the pressure generating chamber 12 to expand from a reference volume, the first expansion maintenance element P02 maintains the volume of the pressure generating chamber 12 which is expanded by the first expanding element P01 for a fixed time, the first contracting element P03 is applied from the first potential $V_1$ to a second potential $V_2$ to cause the volume of the pressure generating chamber 12 to contract, the first contraction maintenance element P04 maintains the volume of the pressure generating chamber 12 which is contracted by the first contracting element P03 for a fixed time, and the first expanding recovery element P05 causes the pressure generating chamber 12 to recover from the contracted state of the second potential $V_2$ to the reference volume of the intermediate potential Vm.

When the first discharge pulse DP1 is supplied to the piezoelectric actuator 300, the piezoelectric actuator 300 deforms in a direction which causes the volume of the pressure generating chamber 12 to expand due to the first expanding element P01, the meniscus inside the nozzle 21 is sucked into the pressure generating chamber 12 side, and the ink is supplied to the pressure generating chamber 12 from the manifold 100 side. The expanded state of the pressure generating chamber 12 is maintained by the first expansion maintenance element P02. Subsequently, the first contracting element P03 is supplied, the pressure generating chamber 12 rapidly contracts from the expanded volume to the contracted volume corresponding to the second potential $V_2$, the ink inside the pressure generating chamber 12 is pressurized, and an ink droplet is discharged from the nozzle 21. The contracted state of the pressure generating chamber 12 is maintained by the first contraction maintenance element P04 and the ink pressure inside the pressure generating chamber 12 which is reduced by the discharging of the ink droplet in this time rises again due to natural vibration. The first expanding recovery element P05 is supplied in accordance with the rising timing, the pressure generating chamber 12 recovers to the reference volume, and the pressure fluctuation inside the pressure generating chamber 12 is absorbed.

In comparison, the second discharge pulse DP2 of the second drive signal COM2 has a drive waveform with the same shape as that of the first discharge pulse DP1. Specifically, the second discharge pulse DP2 includes a second expanding element P11, a second expansion maintenance element P12, a second contracting element P13, a second contraction maintenance element P14, and a second expanding recovery element P15. The second expanding element P11 is applied from a state in which the intermediate potential Vm is applied to the first potential $V_1$ to cause the volume of the pressure generating chamber 12 to expand from the reference volume, the second expansion maintenance element P12 maintains the volume of the pressure generating chamber 12 which is expanded by the second expanding element P11 for a fixed time, the second contracting element P13 is applied from the first potential $V_1$ to the second potential $V_2$ to cause the volume of the pressure generating chamber 12 to contract, the second contraction maintenance element P14 maintains the volume of the pressure generating chamber 12 which is contracted by the second contracting element P13 for a fixed time, and the second expanding recovery element P15 causes the pressure generating chamber 12 to recover from the contracted state of the second potential $V_2$ to the reference volume of the intermediate potential Vm.

The timing at which the second discharge pulse DP2 is supplied to the piezoelectric actuator 300 is caused to deviate, that is, is a different timing in comparison to the timing at which the first discharge pulse DP1 is supplied to the piezoelectric actuator 300. In the present embodiment, the timing at which the second discharge pulse DP2 is supplied to the piezoelectric actuator 300 is earlier than the timing at which the first discharge pulse DP1 is supplied to the piezoelectric actuator 300. In other words, all of the timings (the occurrence periods) of the elements P11 to P15 of the second discharge pulse DP2 are earlier by a time difference Δt than the elements P01 to P05 of the first discharge pulse DP1. The time difference Δt of the supply timing of the second discharge pulse DP2 with respect to the first discharge pulse DP1 is described in detail later; however, a deviation amount which does not overlap the first discharge pulse DP1 of the next unit period T is preferable. In other words, the time difference Δt which is the deviation amount of the second discharge pulse DP2 is preferably a time difference in which all of the elements P11 to P15 of the second discharge pulse DP2 fit inside the unit period T. Accordingly, it is possible to reduce the error between the landing position of the ink droplet which is discharged by the first discharge pulse DP1 and the landing position of the ink droplet which is discharged by the second discharge pulse DP2 and it is possible to render the influence of the air current of the ink droplet which is discharged by the next first discharge pulse DP1 difficult to receive. It is preferable that the time difference Δt be less than or equal to half of the unit period T so as to be a landing position of less than or equal to half of one pixel, that is, since the unit period T corresponds to one pixel. Accordingly, it is possible to suppress the landing position deviation of the ink droplet which is discharged by the second discharge pulse DP2.

The second discharge pulse DP2 having a drive waveform with the same shape as that of the first discharge pulse DP1 means that the waveform shape, such as the voltage which is applied to the piezoelectric actuator 300 and the time (including the inclination) for which the voltage is applied, is the same. In other words, the waveform shapes being the same includes a case in which the timing in the unit period T is different. By setting the second discharge pulse DP2 to the drive waveform with the same shape as that of the first discharge pulse DP1, it is possible to render the flight speed of the ink droplets and the weight per droplet of the ink droplets the same in the ink droplet which is discharged by supplying the first discharge pulse DP1 and the ink droplet which is discharged by the second discharge pulse DP2. In other words, the flight speed of the ink droplets and the weight per droplet of the ink droplets being the same means discharging the ink droplets using drive waveforms of the same waveform shape, and this includes a case in which even if the waveform shapes of the drive waveforms are the same, an error arises in the flight speed of the ink droplets and the weight per droplet of the ink droplets due to structural errors and variation and the like in the voltage characteristics of the piezoelectric actuators 300.

Deviating the timing at which to supply the second discharge pulse DP2 with respect to the timing at which to supply the first discharge pulse DP1 includes not only a case in which the second discharge pulse DP2 is supplied earlier than the first discharge pulse DP1 as described above but also a case in which the second discharge pulse DP2 is supplied later than the first discharge pulse DP1.

Figure 6:
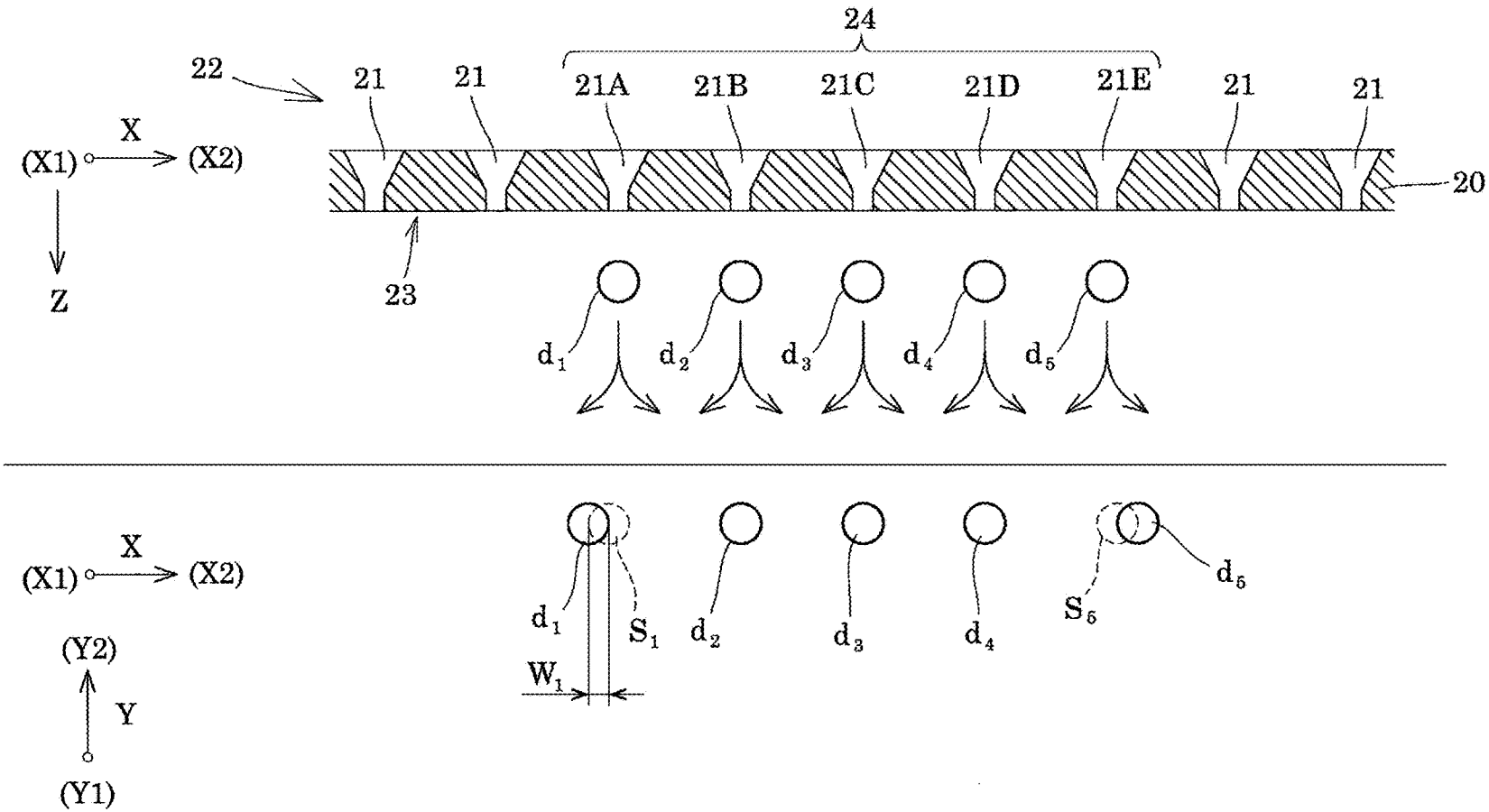
FIG. 6 is a diagram explaining a flight state of ink droplets and a landing state onto a recording sheet.
Figure 7:
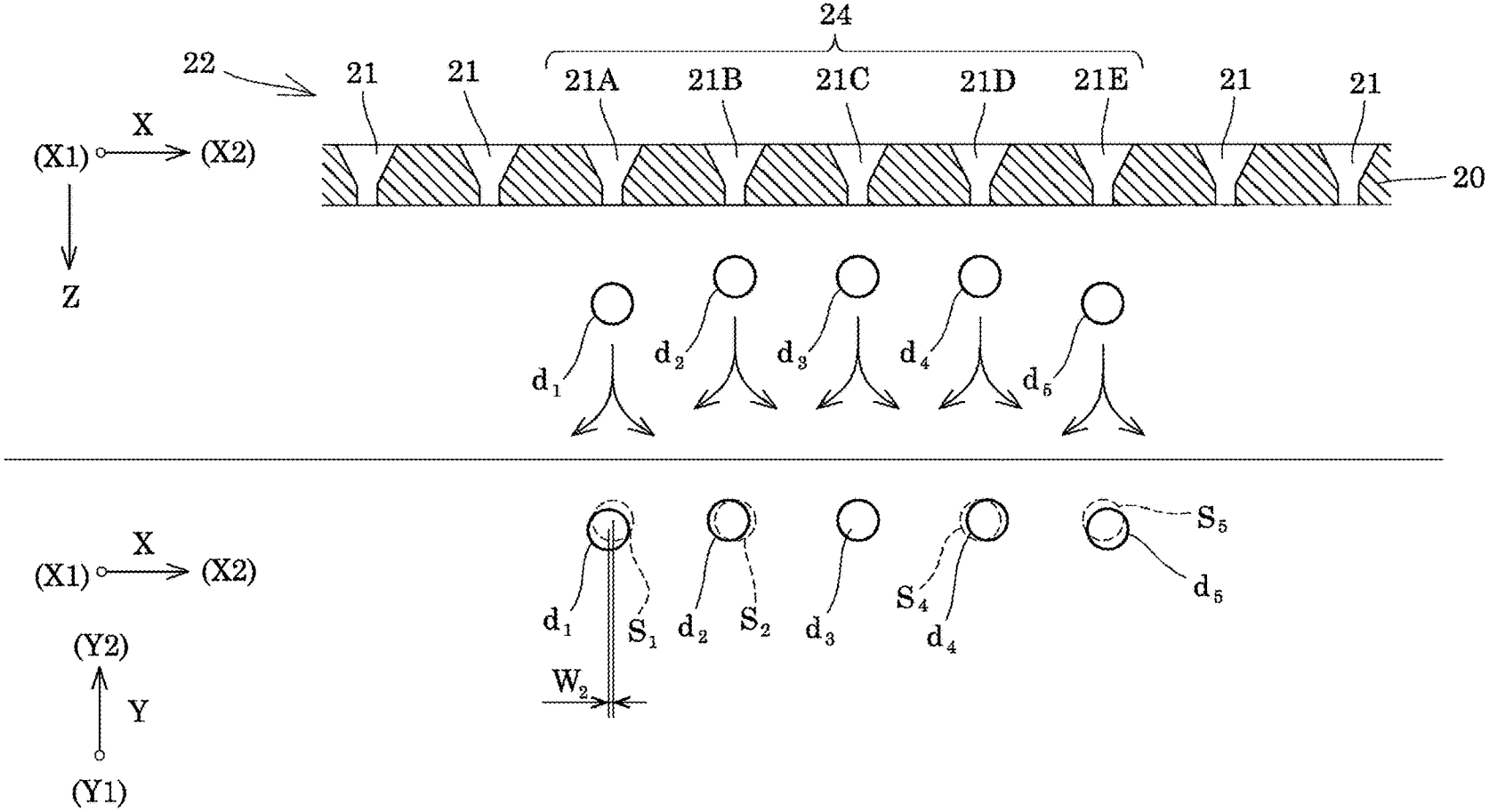
FIG. 7 is a diagram explaining a flight state of ink droplets and a landing state onto a recording sheet.

Here, a description will be given of the flight bending of ink droplets in a case in which the ink droplets are discharged from consecutive nozzles which are adjacent to each other, with reference to FIGS. 6 and 7. FIGS. 6 and 7 are diagrams explaining the flight state of the ink droplets and the landing state onto the recording sheet.

As illustrated in FIG. 6, in the nozzles 21 which discharge the ink droplets, in a case in which five consecutive nozzles 21 which are adjacent to each other, in the present embodiment, these are referred to as a first nozzle 21A, a second nozzle 21B, a third nozzle 21C, a fourth nozzle 21D, and a fifth nozzle 21E in order from the X1 side toward the X2 side are selected, in the nozzle group 24 which is configured by the first nozzle 21A to the fifth nozzle 21E, ink droplets are discharged from the nozzles 21 of both the X1 side and the X2 side of the nozzles 21 other than the first nozzle 21A and the fifth nozzle 21E of the end portions, that is, the second nozzle 21B, the third nozzle 21C, and the fourth nozzle 21D. Therefore, ink droplets $d_2$, $d_3$, and $d_4$ which are discharged from the second nozzle 21B, the third nozzle 21C, and the fourth nozzle 21D, respectively, which are the nozzles 21 other than those of the end portions of the nozzle group 24 are influenced by the air current of the ink droplets which are discharged from the nozzles 21 of both sides and landing position deviation does not occur easily in the first direction X which is the direction in which the nozzles 21 are provided to line up. In comparison, in an ink droplet $d_1$ which is discharged from the first nozzle 21A of one end portion of the nozzle group 24, since the ink droplet $d_2$ is discharged from the second nozzle 21B which is adjacent on one side and an ink droplet is not discharged from the nozzle 21 which is adjacent on the other side, the ink droplet $d_1$ flies bent to the X1 side which is the opposite side from the second nozzle 21B in the first direction X due to the influence of the air current of the ink droplet $d_2$ which is discharged from the second nozzle 21B. Therefore, the ink droplet $d_1$ which is discharged from the first nozzle 21A lands at a position which is caused to deviate to the X1 side in the first direction X with respect to a landing position $S_1$ which is the target on the recording sheet S. The deviation amount of the landing position of the ink droplet $d_1$ in the first direction X in relation to the landing position $S_1$ which is the target at this time is referred to as $W_1$. In the same manner for an ink droplet $d_5$ which is discharged from the fifth nozzle 21E of the other end portion of the nozzle group 24, the ink droplet $d_5$ flies bent to the opposite side from the fourth nozzle 21D due to the influence of the air current of the ink droplet $d_4$ which is discharged from the fourth nozzle 21D and lands at a position which is caused to deviate by the deviation amount $W_1$ to the X2 side in the first direction X with respect to a landing position $S_5$ which is the target on the recording sheet S.

Therefore, in the present embodiment, in the first nozzle 21A to the fifth nozzle 21E which are the nozzles 21 which configure the nozzle group 24, the discharging is performed such that the discharge timing of the ink droplets $d_1$ and $d_5$ which are discharged from the first nozzle 21A and the fifth nozzle 21E which are the nozzles 21 of the end portions, respectively, is a different timing from the discharge timing of the ink droplets $d_2$, $d_3$, and $d_4$ which are discharged from the second nozzle 21B, the third nozzle 21C, and the fourth nozzle 21D which are the nozzles 21 other than those of the end portions, respectively. In the present embodiment, the first discharge pulse DP1 of the first drive signal COM1 is supplied to the piezoelectric actuators 300 corresponding to the second nozzle 21B, the third nozzle 21C, and the fourth nozzle 21D which are the nozzles 21 other than those of the end portions, and the second discharge pulse DP2 of the second drive signal COM2 which has a different discharge timing from that of the first discharge pulse DP1 is supplied to the piezoelectric actuators 300 corresponding to the first nozzle 21A and the fifth nozzle 21E of the end portions. Accordingly, as illustrated in FIG. 7, the ink droplets $d_1$ and $d_5$ which are discharged from the first nozzle 21A and the fifth nozzle 21E, respectively, are discharged at an earlier timing than the discharge timing of the ink droplets $d_2$, $d_3$, and $d_4$ which are discharged from the second nozzle 21B, the third nozzle 21C, and the fourth nozzle 21D, respectively. Since the ink droplet $d_1$ which is discharged from the first nozzle 21A of the one end portion in this manner flies at a different position in the third direction Z from that of the ink droplet $d_2$ which is discharged from the second nozzle 21B, the ink droplet $d_1$ is not easily influenced by the air current of the ink droplet $d_2$ which is discharged from the second nozzle 21B, and, for the ink droplet $d_1$ which is discharged from the first nozzle 21A, it is possible to reduce a deviation amount $W_2$ to the X1 side in the first direction X in comparison to the deviation amount $W_1$ illustrated in FIG. 6 with respect to the landing position $S_1$ which is the target on the recording sheet S. However, since the influence of the air current of the ink droplet $d_1$ which is discharged from the first nozzle 21A on the ink droplet $d_2$ which is discharged from the second nozzle 21B is also reduced, the ink droplet $d_2$ deviates slightly to the X1 side of the first direction X; however, since the deviation amount is little in comparison to the deviation amount $W_1$ in the first direction X of the ink droplet $d_1$ which is discharged from the first nozzle 21A illustrated in FIG. 6, this does not particularly pose a problem. It is possible to reduce the deviation amount to the X2 side of the first direction X with respect to the landing position $S_5$ which is the target also for the ink droplet $d_5$ which is discharged from the fifth nozzle 21E of the end portion of the nozzle group 24 in the same manner. Therefore, in the nozzle row 22, it is possible to suppress the landing position deviation in the first direction X of the ink droplets $d_1$, $d_2$, $d_3$, $d_4$, and $d_5$ which are discharged from the nozzles 21A to 21D of the nozzle group 24 which is configured by the nozzles 21 from which the ink droplets are discharged. Accordingly, it is possible to suppress the occurrence of white streaks along the first direction X caused by the landing position deviation of the nozzles 21 of the end portions of the nozzle group 24 in the image which is recorded on the recording sheet S and it is possible to improve the print quality.

The ink droplets $d_1$ and $d_5$ which are discharged from the first nozzle 21A and the fifth nozzle 21E of the end portions of the nozzle group 24 land earlier on the recording sheet S in comparison to the ink droplets $d_2$, $d_3$, and $d_4$ which are discharged from the second nozzle 21B, the third nozzle 21C, and the fourth nozzle 21D which are the nozzles 21 other than those of the end portions. As described above, since the recording head 1 discharges the ink droplets $d_1$, $d_2$, $d_3$, $d_4$, and $d_5$ while moving in the second direction Y, the ink droplets $d_1$ and $d_5$ which are discharged from the first nozzle 21A and the fifth nozzle 21E are caused to deviate in the second direction Y in comparison to the ink droplets $d_2$, $d_3$, and $d_4$ which are discharged from the second nozzle 21B, the third nozzle 21C, and the fourth nozzle 21D which are the nozzles 21 other than those of the end portions. As described above, the deviation amount in the second direction Y of the ink droplets $d_1$ and $d_5$ is determined by the time difference $\Delta t$ between the supply timing (the discharge timing) of the first discharge pulse DP1 and the supply timing (the discharge timing) of the second discharge pulse DP2 and the movement speed of the carriage 3. Therefore, it is preferable to define the time difference $\Delta t$ such that the ink droplets $d_1$ and $d_5$ which are discharged from the first nozzle 21A and the fifth nozzle 21E of the end portions of the nozzle group 24 have a deviation amount of less than or equal to half of one pixel in the second direction Y with respect to the landing positions $S_1$ and $S_5$ which are the targets. Accordingly, it is possible to improve the print quality by suppressing the landing position deviation in the second direction Y of the ink droplets which are discharged from the first nozzle 21A and the fifth nozzle 21E.

Figure 8:
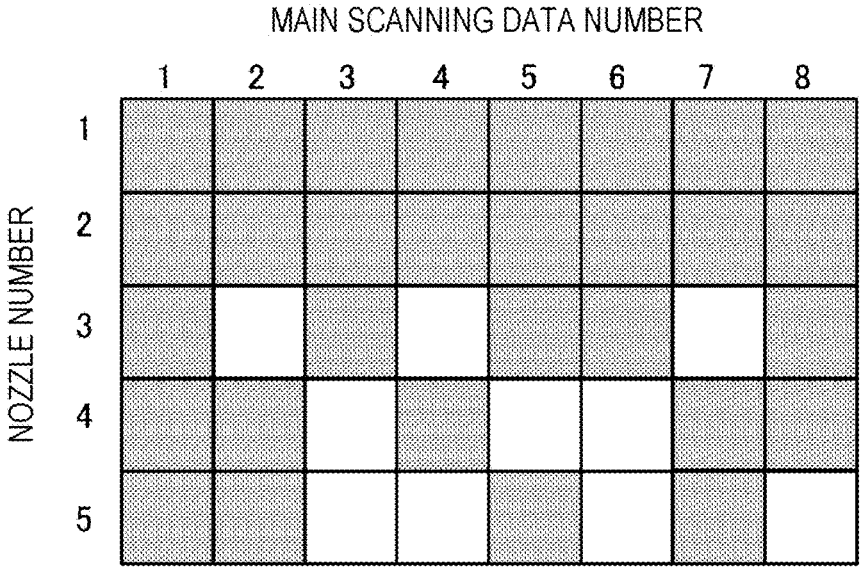
FIG. 8 is a diagram illustrating image data which is an example of recording data.

Here, a description will be given of the specific method of forming an image while moving the recording head 1 in the second direction Y using the five nozzles 21 of the first nozzle 21A to the fifth nozzle 21E. FIG. 8 is a diagram illustrating the image data which is an example of the recording data, FIG. 9 is a diagram illustrating the printed result of an image obtained by a recording method of the related art, and FIG. 10 is a diagram illustrating the printed result of an image of the present embodiment.

The image data which is illustrated in FIG. 8 illustrates numbers of the five nozzles 21 of the first nozzle 21A to the fifth nozzle 21E and main scanning data numbers illustrating the position in the main scanning direction of the recording head 1, in the present embodiment, the second direction Y.

Figure 9:
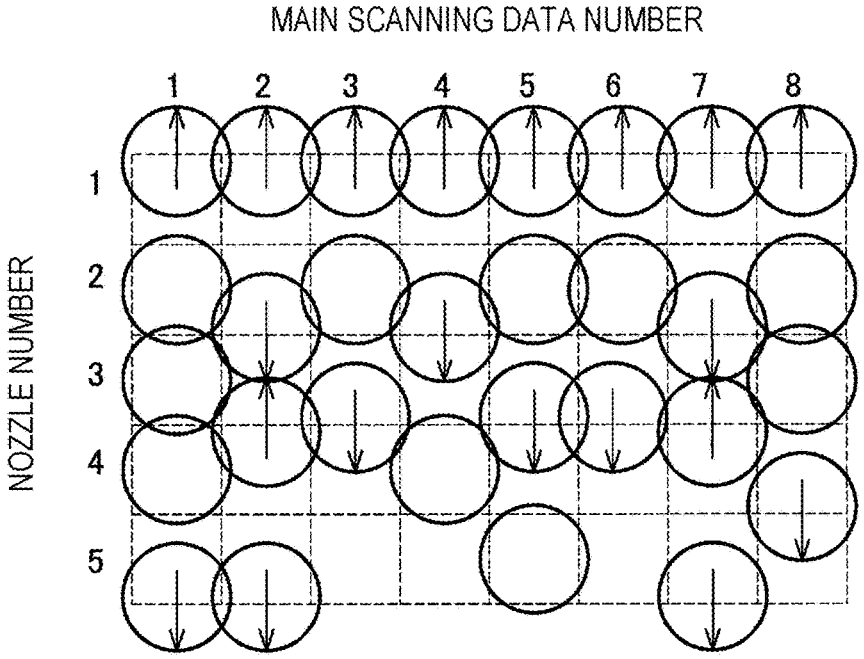
FIG. 9 is a diagram illustrating a printed result of an image.
Figure 10:
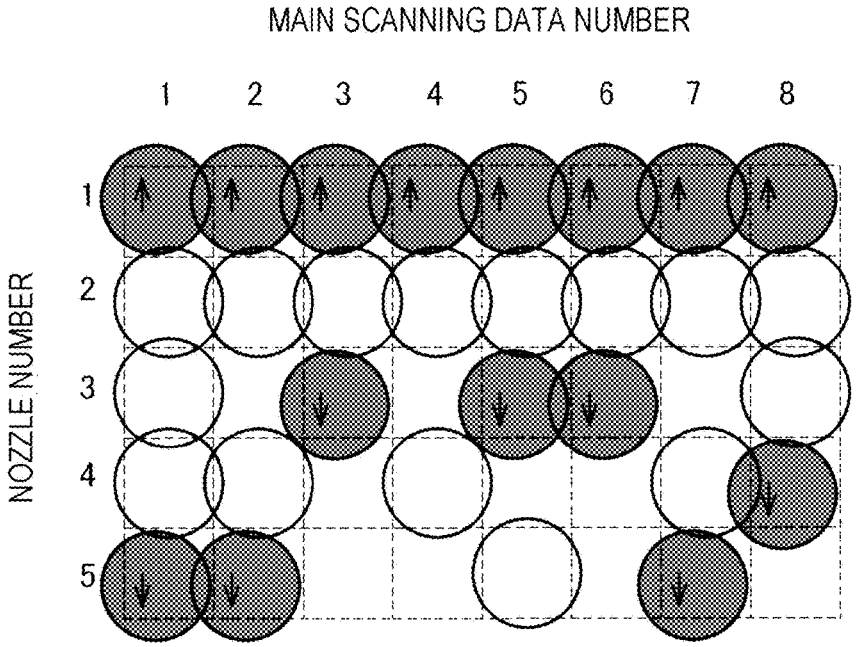
FIG. 10 is a diagram illustrating a printed result of an image.

When the image data which is illustrated in FIG. 8, a single drive signal, for example, only the first drive signal COM1 is supplied to the piezoelectric actuator 300 and an image is printed, as illustrated in FIG. 9, since the ink droplets which are discharged from the nozzles 21 of the end portions of the nozzle groups which are configured by the adjacent nozzles 21 fly bent toward the outside, landing position deviation occurs in the first direction X which is the direction in which the nozzles 21 are provided to line up. Specifically, for example, in the main scanning data number 1, since the ink droplets are discharged from all of the first nozzle 21A to the fifth nozzle 21E, the nozzle group 24 is configured by the five nozzles 21 of the first nozzle 21A to the fifth nozzle 21E. In the nozzle group 24, since the nozzles 21 of the end portions are the first nozzle 21A and the fifth nozzle 21E, landing position deviation of the ink droplets which are discharged from the first nozzle 21A and the fifth nozzle 21E occurs. In the same manner, for example, in the main scanning data number 2, in the consecutive adjacent nozzles 21 from which the ink droplets are discharged, two nozzle groups 24 of the nozzle group 24 which is configured by the first nozzle 21A and the second nozzle 21B and the nozzle group 24 which is configured by the fourth nozzle 21D and the fifth nozzle 21E are formed. In the one nozzle group 24 which is configured by the first nozzle 21A and the second nozzle 21B, since both the first nozzle 21A and the second nozzle 21B are the nozzles 21 of the end portions, the ink droplets which are discharged from the first nozzle 21A and the second nozzle 21B both fly bent toward the outside together and the landing positions are caused to deviate. In the same manner for the other nozzle group 24, the ink droplets which are discharged from the fourth nozzle 21D and the fifth nozzle 21E both fly toward the outside together and the landing positions are caused to deviate. Since, in the fourth nozzle 21D of the main scanning data number 4, ink droplets are not consecutively discharged from adjacent nozzles 21, flight bending does not occur. Even in each of the other main scanning data numbers 3, and 5 to 8, one nozzle group or a plurality of nozzle groups are formed for each of the main scanning data numbers in the same manner.

As illustrated in FIG. 9, when the nozzles 21 of the end portions of the nozzle groups 24 are consecutive in the main scanning direction which is the second direction Y, that is, a portion at which the nozzles 21 of the same nozzle number are consecutive along a plurality of main scanning data numbers to form the nozzles 21 of the end portion, for example, between the nozzle number 1 and the nozzle number 2, a so-called white line is formed which is not covered by the ink droplets due to landing position deviation, that is, a non-printed portion is consecutive in the second direction Y.

Therefore, in the nozzle groups 24 which are formed at each of the main scanning data numbers, a process of deviating the discharge timing of the ink droplets which are discharged from the nozzles 21 of the end portions with respect to the discharge timing of the ink droplets which are discharged from the nozzles 21 other than those of the end portions is performed. Accordingly, as illustrated in FIG. 10, since it is possible to suppress the landing position deviation in the first direction X which is the direction in which the ink droplets which are discharged from the nozzles 21 of the end portions of the nozzle groups 24 which are formed in each of the main scanning data numbers are lined up, it is possible to suppress the formation of white lines in the image which is caused by landing position deviation.

In a case in which there are two of the consecutive adjacent nozzles 21, that is, in a case in which the nozzle group 24 is configured by two nozzles 21, since both of the nozzles 21 are nozzles 21 of the end portions, it is not possible to suppress the landing position deviation in the first direction X even if the discharge timing of both of the nozzles 21 is caused to deviate by the same amount. Therefore, in a case in which two nozzles 21 configure the nozzle group 24, the discharge timing of the ink droplet which is discharged from one nozzle 21 may be caused to deviate with respect to the discharge timing of the ink droplet which is discharged from the other nozzle 21. For example, in the main scanning data number 2, in a case in which the nozzle group 24 is configured by the first nozzle 21A and the second nozzle 21B, the second discharge pulse DP2 of the second drive signal COM2 is applied to the piezoelectric actuator 300 corresponding to the one first nozzle 21A and the first discharge pulse DP1 of the first drive signal COM1 is applied to the piezoelectric actuator 300 corresponding to the other second nozzle 21B. Accordingly, it is possible to suppress the mutual influence of the air currents between the ink droplet which is discharged from the first nozzle 21A and the ink droplet which is discharged from the second nozzle 21B to suppress the landing position deviation of both.

Figure 11:
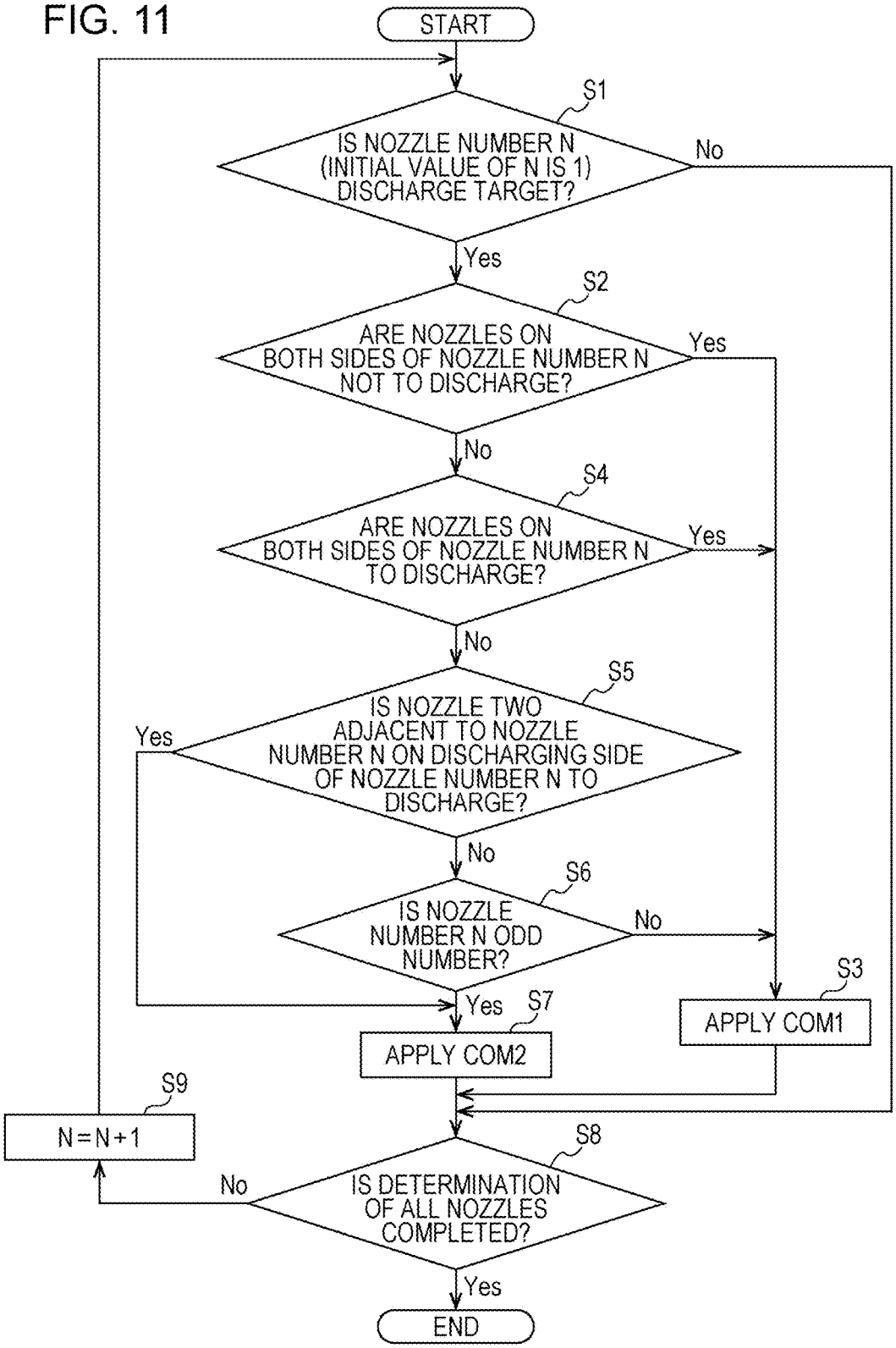
FIG. 11 is a flowchart explaining an image forming method.

A description will be given of the image forming method in the ink jet recording apparatus I of the present embodiment with reference to FIG. 11. FIG. 11 is a flowchart explaining the image forming method. The printer controller 210 assigns numbers to all of the nozzles and generates image data (recording data) which determines discharging and non-discharging based on the assigned nozzle numbers and the main scanning data numbers. In addition to a configuration in which the printer controller 210 assigns numbers to the nozzles, a configuration may be adopted in which nozzle numbers as assigned to the nozzles in advance at the time of shipping or the like and the assigned nozzle numbers are stored in the printer controller 210.

As illustrated in FIG. 11, in step S1, it is determined whether the ink droplet is to be discharged or not to be discharged from the nozzle 21 (the pixel data) of a nozzle number N (the initial value of N is 1), and in a case in which it is determined that the ink droplet is to be discharged from the nozzle 21 of the nozzle number N in step S1 (step S1: Yes), in step S2, it is determined whether ink droplets are not to be discharged from the nozzles 21 of both sides of the nozzle 21 of the nozzle number N. In a case in which it is determined that ink droplets are not to be discharged from the nozzles 21 of both sides of the nozzle 21 of the nozzle number N in step S2 (step S2: Yes), since the nozzle 21 of the nozzle number N becomes a nozzle 21 which is not a nozzle 21 which configured a nozzle group 24 which is configured by consecutive adjacent nozzles 21 which discharge ink droplets, landing position deviation in the first direction X does not occur. Therefore, in step S3, the first discharge pulse DP1 of the first drive signal COM1 is applied to the piezoelectric actuator 300 corresponding to the nozzle 21 of the nozzle number N.

In a case in which it is determined that it is not true that ink droplets are not to be discharged from the nozzles 21 of both sides of the nozzle 21 of the nozzle number N, that is, that ink droplets are to be discharged from either one or both of the nozzles 21 of both sides in step S2 (step S2: No), the nozzle 21 of the nozzle number N is a nozzle 21 which configures the nozzle group 24 which is configured by consecutive adjacent nozzles 21 from which ink droplets are to be discharged. Therefore, in step S4, it is determined whether ink droplets are to be discharged from the nozzles 21 of both sides of the nozzle 21 of the nozzle number N.

In a case in which it is determined that ink droplets are to be discharged from the nozzles 21 of both sides of the nozzle 21 of the nozzle number N in step S4 (step S4: Yes), since the nozzle 21 of the nozzle number N is not a nozzle 21 of an end portion of the nozzle group 24, landing position deviation in the first direction X does not occur. Therefore, in step S3, the first discharge pulse DP1 of the first drive signal COM1 is applied to the piezoelectric actuator 300 corresponding to the nozzle 21 of the nozzle number N.

In a case in which it is determined that ink droplets are not to be discharged from the nozzles 21 of both sides of the nozzle 21 of the nozzle number N, that is, that an ink droplet is to be discharged from only either one of the nozzles 21 of both sides of the nozzle 21 of the nozzle number N in step S4 (step S4: No), the nozzle 21 of the nozzle number N is a nozzle 21 of an end portion of the nozzle group 24. In step S5, it is determined, among the nozzles 21 of both sides of the nozzle 21 of the nozzle number N, whether ink droplets are to be discharged from the nozzle 21 which is adjacent two nozzles 21 away on the discharging side.

In a case in which, among the nozzles 21 of both sides of the nozzle 21 of the nozzle number N, an ink droplet is to be discharged from the nozzle 21 which is adjacent two nozzles 21 away on the discharging side in step S5 (step S5: Yes), since the nozzle 21 of the nozzle number N is a nozzle 21 of the end portion of the nozzle group 24 which is configured by greater than or equal to three nozzles 21, the second discharge pulse DP2 of the second drive signal COM2 is applied to the piezoelectric actuator 300 corresponding to the nozzle 21 of the nozzle number N in step S7.

In a case in which, among the nozzles 21 of both sides of the nozzle 21 of the nozzle number N, it is determined that an ink droplet is not to be discharged from the nozzle 21 which is adjacent two nozzles 21 away on the discharging side in step S5 (step S5: No), since the nozzle 21 of the nozzle number N is a nozzle 21 of the nozzle group 24 which is configured by two nozzles 21, it is determined whether the nozzle number N is an odd number in step S6.

In a case in which the nozzle number N is not an odd number, that is, is an even number in step S6 (step S6: No), the first discharge pulse DP1 of the first drive signal COM1 is applied to the piezoelectric actuator 300 corresponding to the nozzle 21 of the nozzle number N in step S3.

In a case in which it is determined that the nozzle number N is an odd number in step S6 (step S6: Yes), the second discharge pulse DP2 of the second drive signal COM2 is applied to the piezoelectric actuator 300 corresponding to the nozzle 21 of the nozzle number N in step S7. In other words, in step S6, in a case in which the nozzle 21 of the nozzle number N is a nozzle 21 which configures the nozzle group 24 which is configured by two nozzles 21, since both of the two nozzles 21 which configure the nozzle group 24 are the nozzles 21 of the end portions, the discharge timing of the ink droplets which are discharged from the one nozzle 21 and the other nozzle 21 is caused to deviate. In the present embodiment, the first discharge pulse DP1 of the first drive signal COM1 is applied to the piezoelectric actuator 300 of the nozzle 21 of the even nozzle number and the second discharge pulse DP2 of the second drive signal COM2 is applied to the piezoelectric actuator 300 of the nozzle 21 of the odd nozzle number to deviate the discharge timing of the ink droplets which are discharged from the two nozzles 21.

Subsequently, in a case in which it is determined whether the determination of the nozzles 21 of all of the nozzle numbers is completed and the determination of the nozzles of all of the nozzle numbers is completed in step S8 (step S8: Yes), the process ends.

In a case in which it is determined that the determination of the nozzles 21 of all of the nozzle numbers is not complete in step S8 (step S8: No), 1 is added to the nozzle number N, that is, N=N+1 is set in step S9, and step S1 to step S8 are performed repeatedly. Incidentally, in a case in which the ink droplet is not discharged from the nozzle 21 of the nozzle number N in step S1, since the determination of step S2 to step S7 become unnecessary, step S8 onward is performed. By performing the determination of all of the nozzles 21 with respect to one line worth of dot pattern data, it is possible to select whether to supply the first discharge pulse DP1 of the first drive signal COM1 to the piezoelectric actuator 300 corresponding to the nozzle 21, whether to supply the second discharge pulse DP2 of the second drive signal COM2, or whether to not supply the first drive signal COM1 and the second drive signal COM2.

Figure 12:
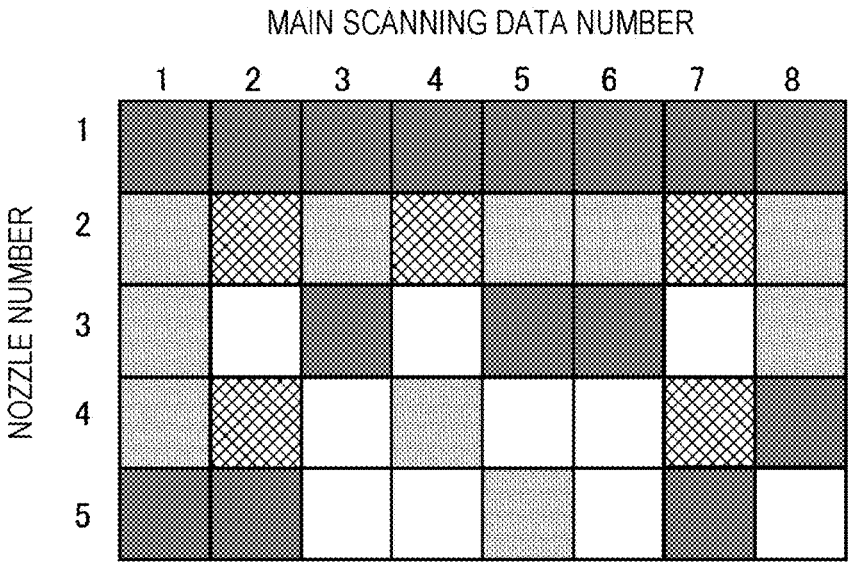
FIG. 12 is a diagram illustrating image data which is an example of recording data.

The determination is performed for every one line worth of dot pattern data of the image data. It is determined as to whether to supply the first discharge pulse DP1 of the first drive signal COM1, whether to supply the second discharge pulse DP2 of the second drive signal COM2, or whether to not supply the first drive signal COM1 and the second drive signal COM2 in each item of pixel data of the image data which is the recording data based on the nozzle numbers and the main scanning data numbers. For example, in the image data illustrated in FIG. 12, when the pixel data is represented by (nozzle number, main scanning data number), since the pixel data (2, 1), (2, 3), (2, 5), (2, 6), (2, 8), (3, 1), (3, 8), (4, 1), (4, 4), and (5, 5) are formed by nozzles 21 other than those of the end portions of the nozzle groups 24 which include greater than or equal to three nozzles 21, step S4 becomes Yes and the first discharge pulse DP1 of the first drive signal COM1 is applied in step S3.

Since the pixel data (1, 1), (1, 3), (1, 5), (1, 6), (1, 8), (3, 3), (3, 5), (3, 6), (4, 8), and (5, 1) are formed by nozzles 21 of the end portions of the nozzle groups 24 which include greater than or equal to three nozzles 21, step S5 becomes Yes and the second discharge pulse DP2 of the second drive signal COM2 is applied in step S7.

Since the pixel data (2, 2), (2, 4), (2, 7), (4, 2), and (4, 7) correspond to the even nozzle numbers in the nozzle groups 24 which include greater than or equal to two nozzles 21, step S6 becomes No and the first discharge pulse DP1 of the first drive signal COM1 is applied in step S3.

Since the pixel data (1, 2), (1, 4), (1, 7), (5, 2), and (5, 7) correspond to the odd nozzle numbers in the nozzle groups 24 which include two nozzles 21, step S6 becomes Yes and the second discharge pulse DP2 of the second drive signal COM2 is applied in step S7.

By determining whether to apply the first discharge pulse DP1 of the first drive signal COM1 or whether to apply the second discharge pulse DP2 of the second drive signal COM2 with respect to the pixel data (nozzle number N, main scanning data number) of the image data and performing the driving, it is possible to suppress the landing position deviation illustrated in FIG. 10 to print an image in which the occurrence of white lines is suppressed.

As described above, in the present embodiment, the necessary nozzles 21 are selected from the nozzle row 22 based on the recording data, ink droplets are discharged from the selected nozzles 21 at a predetermined timing to form dots on the recording sheet S, and among the nozzles 21 which are selected for each timing, the nozzle group 24 is configured by the consecutive nozzles 21 which are adjacent to each other and the discharge timing of the ink droplets which are discharged from the nozzles 21 of the end portions of the nozzle group 24 is caused to deviate with respect to the discharge timing of the ink droplets which are discharged from the nozzles 21 other than those of the end portions. Therefore, since it is possible to suppress the influence of the air currents of the ink droplets which are discharged from the nozzles which are adjacent to the nozzles 21 of the end portions of the nozzles 21 of the nozzle group 24, it is possible to suppress flight bending of the ink droplets which are discharged from the nozzles 21 of the end portions. Therefore, it is possible to suppress the landing position deviation of the ink droplets to improve the print quality.

Since it is not necessary to change the flight speed of the ink droplets which are discharged from the nozzles 21 of the end portions of the nozzle group 24, it is possible to suppress an increasing of the weight per drop of the ink droplets caused by an increase in the flight speed to suppress the occurrence of irregularity in the printing density and it is possible to improve the print quality.

In the present embodiment, the first discharge pulse DP1 and the second discharge pulse DP2 which have different discharge timings but have drive waveforms of the same shape are supplied to the piezoelectric actuators 300 corresponding to the nozzles 21 which configure the nozzle group 24. Therefore, it is possible to render the flight speed of the ink droplets and the weight per droplet of the ink droplets which are discharged from the nozzles 21 which configure the nozzle group 24 the same to suppress the occurrence of irregularity in the printing density and it is possible to improve the print quality.

In the present embodiment, in a case in which two nozzles 21 configure the nozzle group 24, the discharge timing of the ink droplet of one nozzle 21 is caused to deviate with respect to the discharge timing of the ink droplet of the other nozzle 21. Therefore, even if the nozzle group 24 is configured by two nozzles 21, it is possible to reduce flight bending and landing position deviation of the ink droplets which are discharged from the nozzles 21.

In the present embodiment, the amount by which the discharge timing of the ink droplets to be discharged from the nozzles 21 of the end portions of the nozzle group 24, that is, the time difference Δt of the second discharge pulse DP2 with respect to the first discharge pulse DP1 is preferably an amount which does not overlap the drive waveform which is supplied to the piezoelectric actuator 300 at the previous or subsequent timing, that is, does not overlap the first discharge pulse DP1 of the unit period T. Accordingly, it is possible to reduce the error between the landing position of the ink droplet which is discharged by the first discharge pulse DP1 and the landing position of the ink droplet which is discharged by the second discharge pulse DP2 and it is possible to render the influence of the air current of the ink droplet which is discharged by the first discharge pulse DP1 of the previous and the subsequent timing difficult to receive.

In the present embodiment, the amount by which the discharge timing of the ink droplets to be discharged from the nozzles 21 of the end portions of the nozzle group 24, that is, the time difference Δt of the second discharge pulse DP2 with respect to the first discharge pulse DP1 is preferably an amount at which landing position deviation of less than or equal to half a pixel occurs. Accordingly, it is possible to suppress the landing position deviation of the ink droplet which is discharged by the second discharge pulse DP2.

In the present embodiment, it is possible to supply the first drive signal COM1 and the second drive signal COM2 for which the discharge timings of the ink droplets are different from each other to the piezoelectric actuator 300, the first drive signal COM1 is supplied to the piezoelectric actuators 300 corresponding to the nozzles 21 other than those of the end portions of the nozzle group 24, and the second drive signal COM2 is supplied to the piezoelectric actuators 300 corresponding to the nozzles 21 of the end portions of the nozzle group 24. Therefore, it is possible to easily select and supply the first drive signal COM1 and the second drive signal COM2 which have different discharge timings to the piezoelectric actuators 300.

In the example which is described above, the printer controller 210 assigns or stores, in advance, the nozzle numbers of the nozzles 21 and the determination of whether the nozzle number N is an odd number or an even number is performed in step S6; however, the configuration is not limited thereto, for example, whether the nozzle being determined is an odd number nozzle or an even number nozzle may be determined from a predetermined position without assigning or storing, in advance, the nozzle numbers. In other words, for example, the determination of whether the nozzle 21 being determined is an odd number nozzle or an even number nozzle counting from a nozzle of a predetermined position using the first nozzle of the X1 side in the first direction X as the predetermined position. Naturally, the predetermined nozzle is not limited to the nozzle of the end portion of the X1 side, may be the nozzle of the end portion of the X2 side, may be the nozzle which is at the center in the lining up direction of the first direction X, and the position of the nozzle which serves as a reference is not particularly limited.

Other Embodiments

Hereinabove, a description is given of an embodiment of the invention; however, the basic configuration of the invention is not limited to that which is described above.

Figure 13:
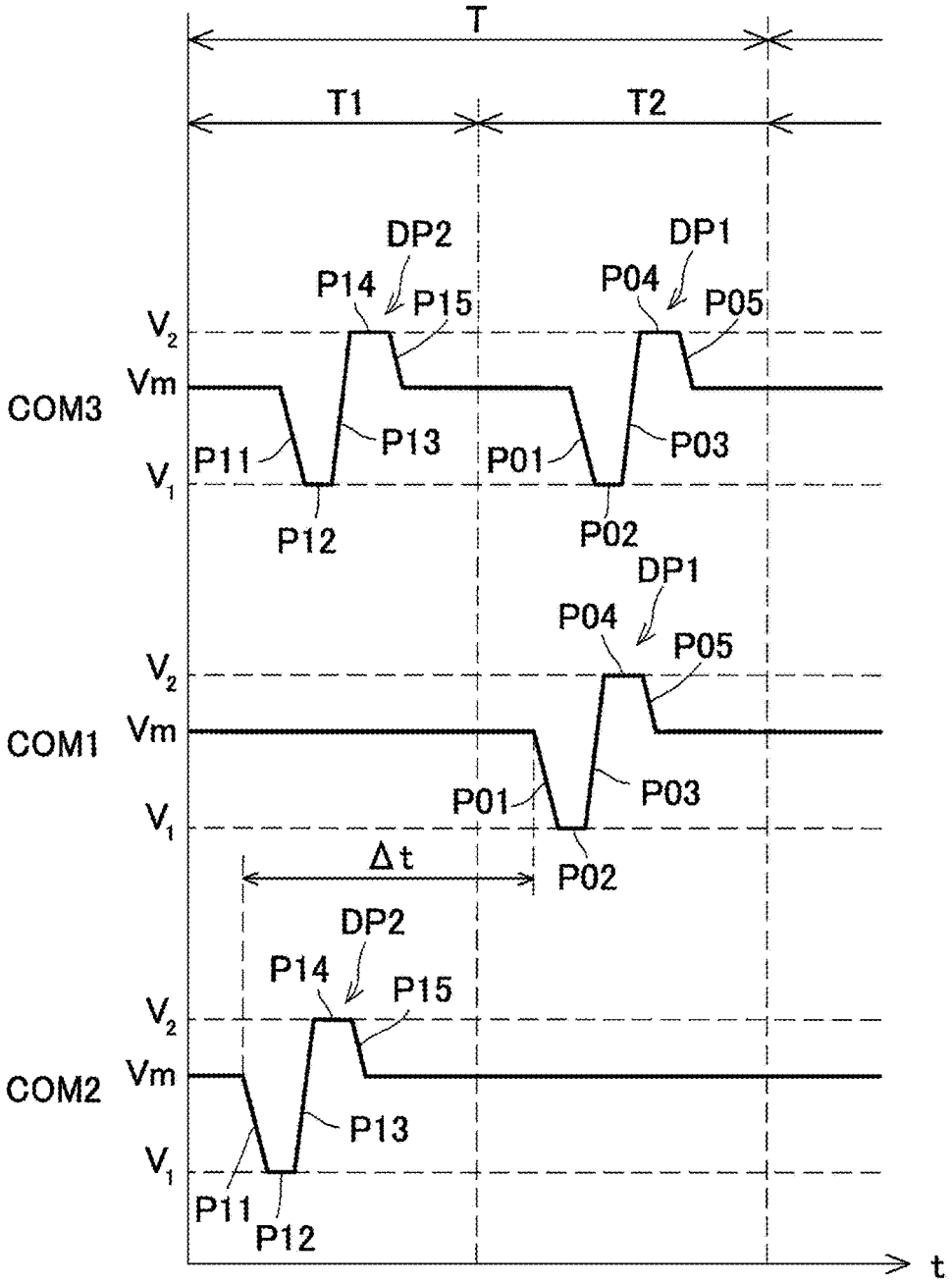
FIG. 13 shows a modification example of drive waveforms illustrating drive signals.
Figure 14:
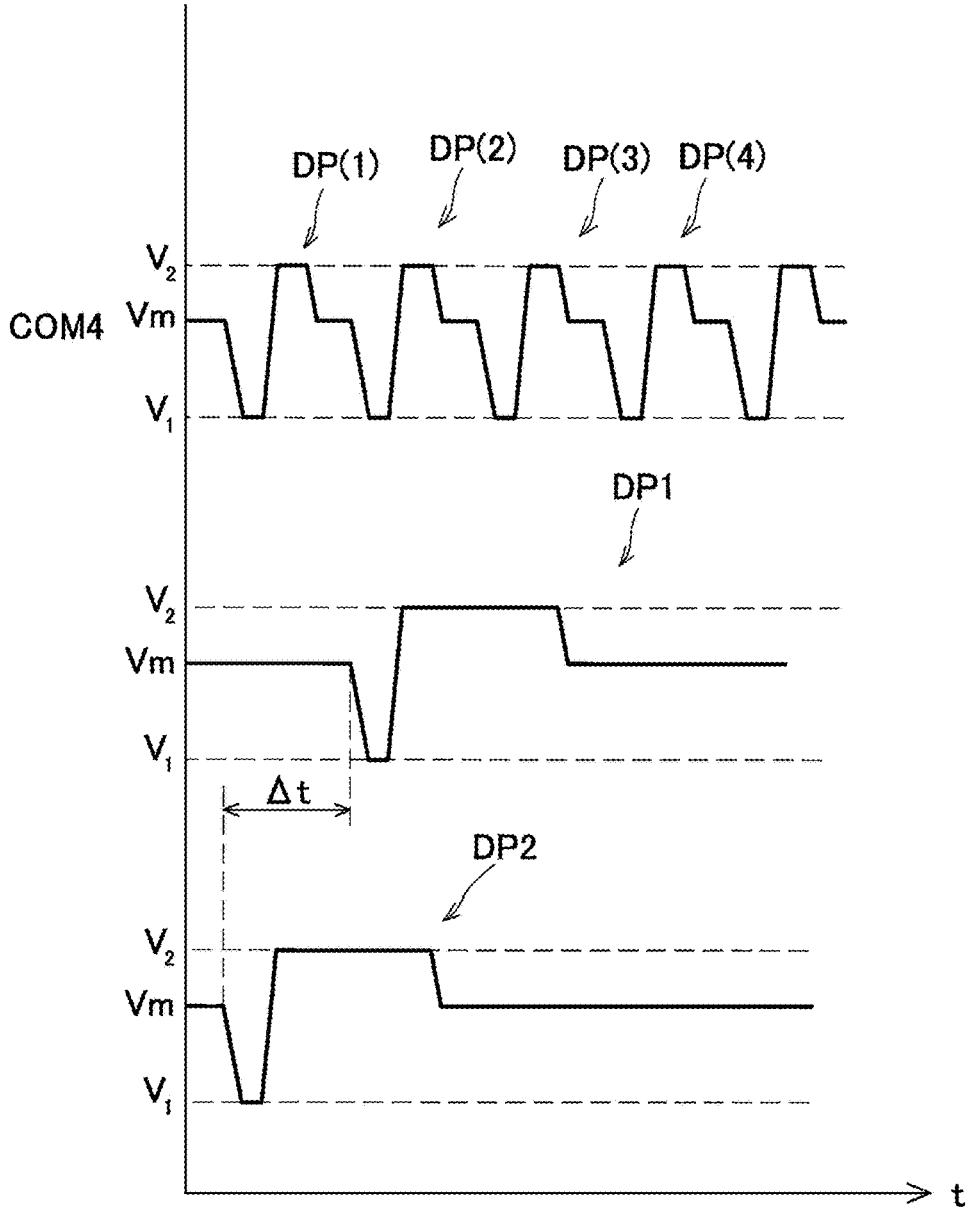
FIG. 14 shows a modification example of drive waveforms illustrating drive signals.

For example, in the first embodiment described above, the first drive signal COM1 which includes the first discharge pulse DP1 repeated in the unit period T and the second drive signal COM2 which includes the second discharge pulse DP2 repeated in the unit period T are generated, and by selecting and applying the first drive signal COM1 and the second drive signal COM2, the discharge timing at which the ink droplets are to be discharged from the nozzles 21 of the end portions which configure the nozzle group is caused to deviate with respect to the discharge timing at which the ink droplets are to be discharged from the nozzles 21 other than those of the end portions. Here, a description will be given of other drive signals with reference to FIGS. 13 and 14. FIGS. 13 and 14 show drive waveforms illustrating modification examples of drive signals.

As illustrated in FIG. 13, in a drive signal COM3, the unit period T corresponding to one pixel worth is divided into two periods T1 and T2. In the first period T1, the second discharge pulse DP2 is generated and in the second period T2, the first discharge pulse DP1 is generated.

It is possible to apply only the first discharge pulse DP1 to the nozzles 21 other than those of the end portions of the nozzles which configure a nozzle group and the nozzles of even nozzle numbers among the nozzles which configure two nozzle groups due to the second period T2 of the drive signal COM3 being selected.

It is possible to apply only the second discharge pulse DP2 to the nozzles of the end portions of the nozzles of nozzle groups which are configured by greater than or equal to three nozzles and the nozzles of odd nozzle numbers among the nozzles which configure two nozzle groups due to the first period T1 of the drive signal COM3 being selected.

By using the drive signal COM3 which includes the first discharge pulse DP1 and the second discharge pulse DP2, it is possible to select and apply the first discharge pulse DP1 and the second discharge pulse DP2. Since one type of the drive signal COM3 is sufficient, it is possible to simplify the configuration of the printer controller 210 which is the control unit and it is possible to reduce the cost. However, since the unit period T of the drive signal COM3 is long in comparison to the unit period T of the first drive signal COM1 and the second drive signal COM2 of the first embodiment which is described above (T2 is the unit period T of the first drive signal COM1 and T1 is the unit period T of the second drive signal COM2), the printing speed is reduced. In other words, since using the two first drive signal COM1 and the second drive signal COM2 of the first embodiment which is described above enables the time difference Δt to be set arbitrarily short, it is possible to suppress a lengthening of the unit period T (the recording period) and to suppress a reduction in the printing speed.

As illustrated in FIG. 14, in a drive signal COM4, by generating a reference discharge pulse DP which serves as a reference in a short period and combining and compositing a plurality of reference discharge pulses DP, the first discharge pulse DP1 and the second discharge pulse DP2 which have different discharge timings of the ink droplets may be generated. For example, in the example illustrated in FIG. 14, a reference discharge pulse DP(2) and a reference discharge pulse DP(3) are composited to generate the first discharge pulse DP1. A reference discharge pulse DP(1) which is generated before the reference discharge pulse DP(2) and the reference discharge pulse DP(2) are composited to generate the second discharge pulse DP2. Even if the first discharge pulse DP1 and the second discharge pulse DP2 are generated in this manner, since the second discharge pulse DP2 is discharged early by the time difference Δt with respect to the first discharge pulse DP1, it is possible to cause the discharge timings of the ink droplets to deviate by the time difference Δt.

In the first embodiment which is described above, the nozzles 21 which are to not discharge are not supplied drive signals; however, the configuration is not particularly limited thereto, and micro vibration drive signals which cause micro vibrations that vibrate the meniscus of the nozzles 21 to an extent at which ink droplets are not discharged.

In the first embodiment which is described above, a configuration is exemplified in which the first drive signal COM1 includes the first discharge pulse DP1; however, the configuration is not particularly limited thereto, and the first drive signal COM1 may include different discharge pulses which discharge ink droplets having different diameters or a plurality of greater than or equal to two discharge pulses in the unit period T. In a case in which the first drive signal COM1 includes greater than or equal to two discharge pulses in the unit period T, the second drive signal COM2 may include a plurality of discharge pulses having different discharge timings with respect to the respective plurality of discharge pulses of the first drive signal COM1.

In the first embodiment which is described above, a piezoelectric actuator of a thin film type is used as the pressure generating unit that generates a pressure change in the pressure generating chamber 12; however, the invention is not particularly limited thereto, for example, a configuration may be adopted which uses a piezoelectric actuator of a thick film type, which is formed using a method such as bonding green sheets, a piezoelectric actuator of a longitudinal oscillation type in which a piezoelectric material and an electrode forming material are alternately laminated and caused to expand and contract in an axial direction, or the like. As the pressure generating unit, it is possible to use a unit in which a heating element is disposed inside a pressure generating chamber and liquid droplets are discharged from a nozzle opening due to a bubble generated by the heating of the heating element. It is also possible to use a so-called electrostatic actuator which generates static electricity between a diaphragm and an electrode to cause liquid droplets to be discharged from a nozzle opening by causing the diaphragm to deform using an electrostatic force.

In the ink jet recording apparatus I which is described above, a configuration is exemplified in which the recording head 1 is mounted on the carriage 3 and moves in the second direction Y which is the main scanning direction; however, the configuration is not particularly limited thereto, and, for example, it is also possible to apply the invention to a so-called line recording apparatus in which the recording head 1 is fixed and the printing is performed only by causing the recording sheet S such as the paper to move in the first direction X. In the case of the line recording apparatus, the direction in which the nozzles 21 are provided to line up is the second direction Y which is perpendicular to the transport direction (the first direction X) of the recording sheet S and the main scanning direction which defines the main scanning data numbers is exchangeable with the first direction X which is the relative movement direction between the recording head 1 and the recording sheet S.

In the embodiments which are described above, a configuration is exemplified in which the printer controller 210 realizes a function of deviating the discharge timing of the ink droplets which are discharged from the nozzles 21 of the end portions of the nozzle group 24 which controls the discharging of the ink droplets with respect to the discharge timing of the ink droplets which are discharged from the nozzles other than those of the end portions. For example, in the external device such as the host computer, a control program is read and executed from a recording medium stored in which is the control program which realizes the function of controlling the discharging of the ink droplets which causes the discharge timing of the ink droplets which are discharged from the nozzles 21 of the end portions of the nozzle group 24 to deviate with respect to the discharge timing of the ink droplets which are discharged from the nozzles other than those of the end portions. In other words, it is possible to deviate the discharge timing of the ink droplets which are discharged from the nozzles 21 of the end portions of the nozzle group 24 with respect to the discharge timing of the ink droplets which are discharged from the nozzles other than those of the end portions using the printer driver of the external device or the like. In this case, the control device is capable of connecting the external device to the ink jet recording apparatus and includes a control unit which realizes a function of deviating the discharge timing of the ink droplets. In the case in which the external device such as the host computer is the control device which includes the control unit which realizes the function of deviating the discharge timing of the ink droplets, it is possible to form a recording system which includes the ink jet recording apparatus and the control device which is connected to the ink jet recording apparatus.

Furthermore, the invention widely targets liquid ejecting heads in general. For example, the invention can be applied to a recording head such as various types of ink jet recording head that is used in an image recording apparatus such as a printer, a color material ejecting head which is used in the manufacture of color filters of liquid crystal displays and the like, an electrode material ejecting head which is used in electrode formation of organic EL displays, Field Emission Displays (FED), and the like, and a biological organic matter ejecting head which is used in the manufacture of biochips.

What is claimed is:

1. A liquid ejecting apparatus comprising:

a nozzle row in which nozzles which discharge a liquid are provided to line up;

drive elements for discharging the liquid from the nozzles; and a control unit which drives the drive elements to cause the liquid to be discharged from the nozzles, wherein the control unit selects the nozzles which are necessary from the nozzle row based on recording data and causes the liquid to be discharged from the nozzles which are selected at a predetermined timing, and wherein a nozzle group is configured by consecutive nozzles which are adjacent to each other among the nozzles which are selected at each timing and a discharge timing of the liquid to be discharged from the nozzles of end portions of the nozzle group is caused to deviate with respect to the discharge timing of the liquid to be discharged from the nozzles other than those of the end portions, wherein the discharge timing of the nozzles other than those of the end portions is substantially the same.

2. The liquid ejecting apparatus according to claim 1, wherein the control unit supplies drive waveforms of the same shape to the drive elements corresponding to the nozzles which configure the nozzle group.

3. The liquid ejecting apparatus according to claim 1, wherein in a case in which two nozzles configure the nozzle group, the discharge timing of the liquid of one nozzle is caused to deviate with respect to the discharge timing of the liquid of the other nozzle.

4. The liquid ejecting apparatus according to claim 1, wherein an amount by which the control unit causes the discharge timing of the liquid to be ejected from the nozzles of the end portions of the nozzle group to deviate is an amount which does not overlap the drive waveforms which are supplied to the drive elements at a previous or a subsequent timing.

5. The liquid ejecting apparatus according to claim 1, wherein an amount by which the control unit causes the discharge timing of the liquid to be ejected from the nozzles of the end portions of the nozzle group to deviate is an amount at which landing position deviation of less than or equal to half of one pixel on occurs on an ejection target medium.

6. The liquid ejecting apparatus according to claim 1, wherein the control unit performs control with respect to the nozzle which is selected such that in a case in which the liquid is not ejected from the nozzles on both sides adjacent to the selected nozzle, a first discharge pulse is supplied to the drive element corresponding to the selected nozzle, in a case in which the liquid is ejected from the nozzles of both sides adjacent to the selected nozzle, the first discharge pulse is supplied to the drive element corresponding to the selected nozzle, in a case in which the liquid is ejected from one of the nozzles which are adjacent to the selected nozzle which is also a case in which the liquid is ejected from the nozzle which is adjacent two nozzles away from the selected nozzle on the one nozzle side, a second discharge pulse of a different discharge timing from that of the first discharge pulse is supplied to the drive element corresponding to the selected nozzle, and in a case in which the liquid is ejected from one nozzle among the nozzles which are adjacent to the selected nozzle which is also a case in which the liquid is not ejected from the nozzle which is adjacent two nozzles away from the selected nozzle on the one nozzle side, the second discharge pulse is supplied to the drive element corresponding to the nozzle which is either an odd number of nozzles or an even number of nozzles away from a predetermined position among the nozzles which configure the nozzle row and the first discharge pulse is supplied to the drive element corresponding to the other nozzle.

7. The liquid ejecting apparatus according to claim 1, wherein a flight speed of the liquid which is ejected from the nozzles which configure the consecutive nozzle group is the same.

8. The liquid ejecting apparatus according to claim 1, wherein a weight of the liquid which is ejected from the nozzles which configure the consecutive nozzle group is the same.

9. The liquid ejecting apparatus according to claim 1, wherein the control unit performs control such that a first drive signal and a second drive signal having different discharge timing of the liquid from each other are supplied to the drive elements, the first drive signal is supplied to the drive elements corresponding to the nozzles other than those of the end portions of the nozzle group, and the second drive signal is supplied to the drive elements corresponding to the nozzles of the end portions of the nozzle group.

10. The liquid ejecting apparatus according to claim 1, wherein the control unit performs control such that a drive signal which includes discharge pulses which are repeated in a unit period and in which the discharge pulses include a first discharge pulse and a second discharge pulse is supplied to the drive elements, the first discharge pulse is supplied to the drive elements corresponding to the nozzles other than those of the end portions of the nozzle group, and the second discharge pulse is supplied to the drive elements corresponding to the nozzles of the end portions of the nozzle group.

11. The liquid ejecting apparatus according to claim 1, wherein the control unit performs control such that a drive signal including a plurality of reference discharge pulses is generated, a first discharge pulse which is formed by selecting and compositing a plurality of the reference discharge pulses is supplied to the drive elements corresponding to the nozzles other than those of the end portions of the nozzle group, and a second discharge pulse which is formed by deviating a selection position of the reference discharge pulse before compositing is supplied to the drive elements corresponding to the nozzles of the end portions of the nozzle group.

12. A control device which is capable of being connected to a liquid ejecting apparatus that includes a nozzle row in which nozzles which discharge a liquid are provided to line up and drive elements for discharging the liquid from the nozzles, the control device comprising:

a control unit which drives the drive elements to cause the liquid to be discharged from the nozzles, wherein the control unit selects the nozzles which are necessary from the nozzle row based on recording data and causes the liquid to be discharged from the nozzles which are selected at a predetermined timing, and wherein a nozzle group is configured by consecutive nozzles which are adjacent to each other among the nozzles which are selected at each timing and a discharge timing of the liquid to be discharged from the nozzles of end portions of the nozzle group is caused to deviate with respect to the discharge timing of the liquid to be discharged from the nozzles other than those of the end portions, wherein the discharge timing of the nozzles other than those of the end portions is substantially the same.

13. A recording system comprising:

the control device according to claim 12; and a liquid ejecting apparatus which is capable of being connected to the control device and includes a nozzle row in which nozzles which perform ejecting are provided to line up and drive elements for ejecting a liquid from the nozzles.

14. A tangible non-transitory computer readable medium having stored thereon computer executable code that, when executed, enable a method of a liquid of a liquid ejecting apparatus which includes a nozzle row in which nozzles which discharge a liquid are provided to line up and drive elements for discharging the liquid from the nozzles, the control method comprising: selecting the nozzles which are necessary from the nozzle row based on recording data and causing the liquid to be discharged from the nozzles which are selected at a predetermined timing; and configuring a nozzle group by consecutive nozzles which are adjacent to each other among the nozzles which are selected at each timing and causing a discharge timing of the liquid to be discharged from the nozzles of end portions of the nozzle group to deviate with respect to the discharge timing of the liquid to be discharged from the nozzles other than those of the end portions, wherein the discharge timing of the nozzles other than those of the end portions is substantially the same.

15. An image forming method of a liquid ejecting apparatus which includes a nozzle row in which nozzles which discharge a liquid are provided to line up and drive elements for discharging the liquid from the nozzles, the method comprising:

selecting the nozzles which are necessary from the nozzle row based on recording data and causing the liquid to be discharged from the nozzles which are selected at a predetermined timing; and configuring a nozzle group by consecutive nozzles which are adjacent to each other among the nozzles which are selected at each timing and causing a discharge timing of the liquid to be discharged from the nozzles of end portions of the nozzle group to deviate with respect to the discharge timing of the liquid to be discharged from the nozzles other than those of the end portions, wherein the discharge timing of the nozzles other than those of the end portions is substantially the same.

* * * * *